US007751751B2

(12) United States Patent
Ohta et al.

(10) Patent No.: US 7,751,751 B2
(45) Date of Patent: Jul. 6, 2010

(54) IMAGE FORMING APPARATUS AND DAMPER

(75) Inventors: Yoshihide Ohta, Sagamihara (JP); Takuji Takahashi, Yokohama (JP); Takamasa Shiraki, Yokohama (JP); Takayuki Andoh, Kawasaki (JP); Shigeo Nanno, Kyoto (JP)

(73) Assignee: Ricoh Company, Ltd., Tokyo (JP)

( * ) Notice: Subject to any disclaimer, the term of this patent is extended or adjusted under 35 U.S.C. 154(b) by 161 days.

(21) Appl. No.: 12/219,206

(22) Filed: Jul. 17, 2008

(65) Prior Publication Data

US 2009/0022516 A1 Jan. 22, 2009

(30) Foreign Application Priority Data

Jul. 19, 2007 (JP) ..... 2007-188897
Dec. 25, 2007 (JP) ..... 2007-331391

(51) Int. Cl.
*G03G 15/00* (2006.01)

(52) U.S. Cl. ..... 399/125

(58) Field of Classification Search ..... 399/107, 399/113, 114, 125, 124, 126
See application file for complete search history.

(56) References Cited

U.S. PATENT DOCUMENTS 4,548,491 A * 10/1985 Eiland ..... 399/107
4,641,947 A * 2/1987 Ishida et al. ..... 399/125
4,849,791 A * 7/1989 Hagihara et al. ..... 399/360
5,175,583 A * 12/1992 Noh et al. ..... 399/107
5,331,374 A * 7/1994 Abe et al. ..... 399/124
5,379,092 A * 1/1995 Takashima ..... 399/125
5,634,178 A * 5/1997 Sugiura et al. ..... 399/110
7,164,878 B2 * 1/2007 Yamanaka ..... 399/122
7,245,855 B2 * 7/2007 Yasumoto ..... 399/124
7,388,593 B2 6/2008 Fukuda (Continued)

FOREIGN PATENT DOCUMENTS

JP 63-055292 3/1988

(Continued)

OTHER PUBLICATIONS

Office Action dated Sep. 30, 2009 for related U.S. Appl. No. 11/987,609.

(Continued)

*Primary Examiner*—David P Porta
*Assistant Examiner*—Kiho Kim
(74) *Attorney, Agent, or Firm*—Harness, Dickey & Pierce, P.L.C.

(57) ABSTRACT

In an image forming apparatus, an upper unit rotates about a first shaft provided in an image forming device for forming an image on a sheet with respect to the image forming device. A slide portion is provided on the upper unit to slide in a forward direction toward a side of the image forming device in which the first shaft is provided and a backward direction opposite to the forward direction. The forward direction and the backward direction are perpendicular to an axial direction of the first shaft. A force applier applies a force to the upper unit in an open direction in which the upper unit is opened with respect to the image forming device. A force adjuster decreases the force applied by the force applier to the upper unit as the slide portion slides with respect to the upper unit in the forward direction.

12 Claims, 13 Drawing Sheets

U.S. PATENT DOCUMENTS

| | | | | |
|---|---|---|---|---|
| 7,421,228 | B2 | 9/2008 | Tomura | |
| 7,433,629 | B2 | 10/2008 | Tomatsu | |
| 2002/0041775 | A1* | 4/2002 | Ishii | 399/124 |
| 2004/0223076 | A1* | 11/2004 | Nakano et al. | 348/363 |
| 2004/0247337 | A1* | 12/2004 | Ohama et al. | 399/107 |
| 2005/0214028 | A1* | 9/2005 | Yasumoto | 399/124 |
| 2007/0196128 | A1* | 8/2007 | Ishihara et al. | 399/125 |
| 2008/0063430 | A1* | 3/2008 | Nobuoka et al. | 399/124 |
| 2009/0029741 | A1* | 1/2009 | Satou et al. | 455/566 |

FOREIGN PATENT DOCUMENTS

| | | |
|---|---|---|
| JP | 04-053988 | 5/1992 |
| JP | 05-197225 | 8/1993 |
| JP | 05-323686 | 12/1993 |
| JP | 05-330713 | 12/1993 |
| JP | 11-038714 | 2/1999 |
| JP | 11-084982 | 3/1999 |
| JP | 2001-022143 | 1/2001 |
| JP | 3176411 | 4/2001 |
| JP | 2001-343880 | 12/2002 |
| JP | 2002-361975 | 12/2002 |
| JP | 2002-365864 | 12/2002 |
| JP | 3446928 | 7/2003 |
| JP | 3617243 | 11/2004 |
| JP | 2005-167801 | 6/2005 |
| JP | 2005-242267 | 9/2005 |

OTHER PUBLICATIONS

English language abstract of JP 05-219308 dated Aug. 27, 1993.
English language abstract of JP 10-063053 dated Mar. 6, 1998.
English language abstract of JP 10-278366 dated Oct. 20, 1998.

* cited by examiner

IMAGE FORMING APPARATUS AND DAMPER

PRIORITY STATEMENT

The present patent application claims priority from Japanese Patent Application Nos. 2007-188897, filed on Jul. 19, 2007, and 2007-331391, filed on Dec. 25, 2007 in the Japan Patent Office, the entire contents of each of which are hereby incorporated herein by reference.

BACKGROUND OF THE INVENTION

1. Field of the Invention

Example embodiments generally relate to an image forming apparatus and a damper, for example, for absorbing shock.

2. Description of the Related Art

A related-art image forming apparatus, such as a copier, a printer, a facsimile machine, or a multifunction printer having at least one of copying, printing, scanning, and facsimile functions, typically forms a toner image on a recording medium (e.g., a recording sheet) by electrophotography.

When a recording sheet is jammed in such image forming apparatus or when a toner cartridge needs to be replaced, for example, a user of the image forming apparatus may open an upper cover provided in an upper portion of the image forming apparatus to expose an interior of the image forming apparatus. However, a heavy scanner is often mounted on the upper cover, requiring the user to open the upper cover with a strong force. Moreover, when the user closes the upper cover, the upper cover may quickly rotate due to its weight and may damage the user or elements included in the image forming apparatus.

To address those problems, a damper for absorbing shock is generally provided on a rotary shaft of the upper cover. Thus, for example, one example of the image forming apparatus includes an upper cover and a body. The upper cover is rotatable about a rotary shaft and an arm. One end of the arm is attached to the upper cover in such a manner that the arm is rotatable about the rotary shaft of the upper cover. Another end of the arm is guided along a guide surface provided in the body. A torsion spring is provided on the rotary shaft of the upper cover and presses the other end of the arm toward the guide surface. Namely, the arm pressing the guide surface generates a force for rotating the upper cover in an open direction, in which the upper cover is opened with respect to the body. Thus, a user of the image forming apparatus may open the upper cover with a decreased force. When the user closes the upper cover, the force for rotating the upper cover in the open direction decreases a force for rotating the upper cover in a close direction caused by weight of the upper cover. Consequently, the upper cover does not close too quickly.

In some image forming apparatuses, a sheet stacker is provided between the upper cover and the scanner to save space. In this case, the scanner is slidable with respect to the upper cover, so that the user may easily identify and pick up a recording sheet on the sheet stacker.

However, when the scanner slides, a center of gravity of the scanner moves with respect to the upper cover. For example, when the scanner slides toward a rear side of the image forming apparatus in which the rotary shaft of the upper cover is provided, the center of gravity of the scanner also moves toward the rear side of the image forming apparatus. When the damper provides a damper performance optimized for opening the upper cover before the scanner starts sliding, the center of gravity of the scanner moved toward the rear side of the image forming apparatus amplifies a force for rotating the upper cover in the open direction applied by the damper. Consequently, the upper cover may quickly rotate toward the rear side of the image forming apparatus. Moreover, the center of gravity of the scanner moved toward the rear side of the image forming apparatus and the force applied by the damper to rotate the upper cover in the open direction may require the user to apply a strong force to close the upper cover.

Obviously, such unstable opening and closing of the upper cover are undesirable, and accordingly, there is a need for a technology to provide stable opening and closing of the upper cover even when the upper cover carries a heavy slidable device.

SUMMARY

At least one embodiment may provide an image forming apparatus that includes an image forming device, a first shaft, an upper unit, a slide portion, a force applier, and a force adjuster. The image forming device forms an image on a sheet. The first shaft is provided in the image forming device. The upper unit rotates about the first shaft with respect to the image forming device. The slide portion is provided on the upper unit to slide in a forward direction toward a side of the image forming device in which the first shaft is provided and a backward direction opposite to the forward direction. The forward direction and the backward direction are perpendicular to an axial direction of the first shaft. The force applier applies a force to the upper unit in an open direction in which the upper unit is opened with respect to the image forming device. The force adjuster decreases the force applied by the force applier to the upper unit as the slide portion slides with respect to the upper unit in the forward direction.

At least one embodiment may provide a damper provided between a lower unit and an upper unit carrying a slide portion for sliding in a direction perpendicular to an axial direction of a first shaft provided in the lower unit. The upper unit is rotatable about the first shaft with respect to the lower unit. The damper includes a force applier and a force adjuster. The force applier applies a force to the upper unit in an open direction in which the upper unit is opened with respect to the lower unit. The force adjuster decreases the force applied by the force applier to the upper unit as the slide portion slides with respect to the upper unit in a forward direction toward a side of the lower unit in which the first shaft is provided.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
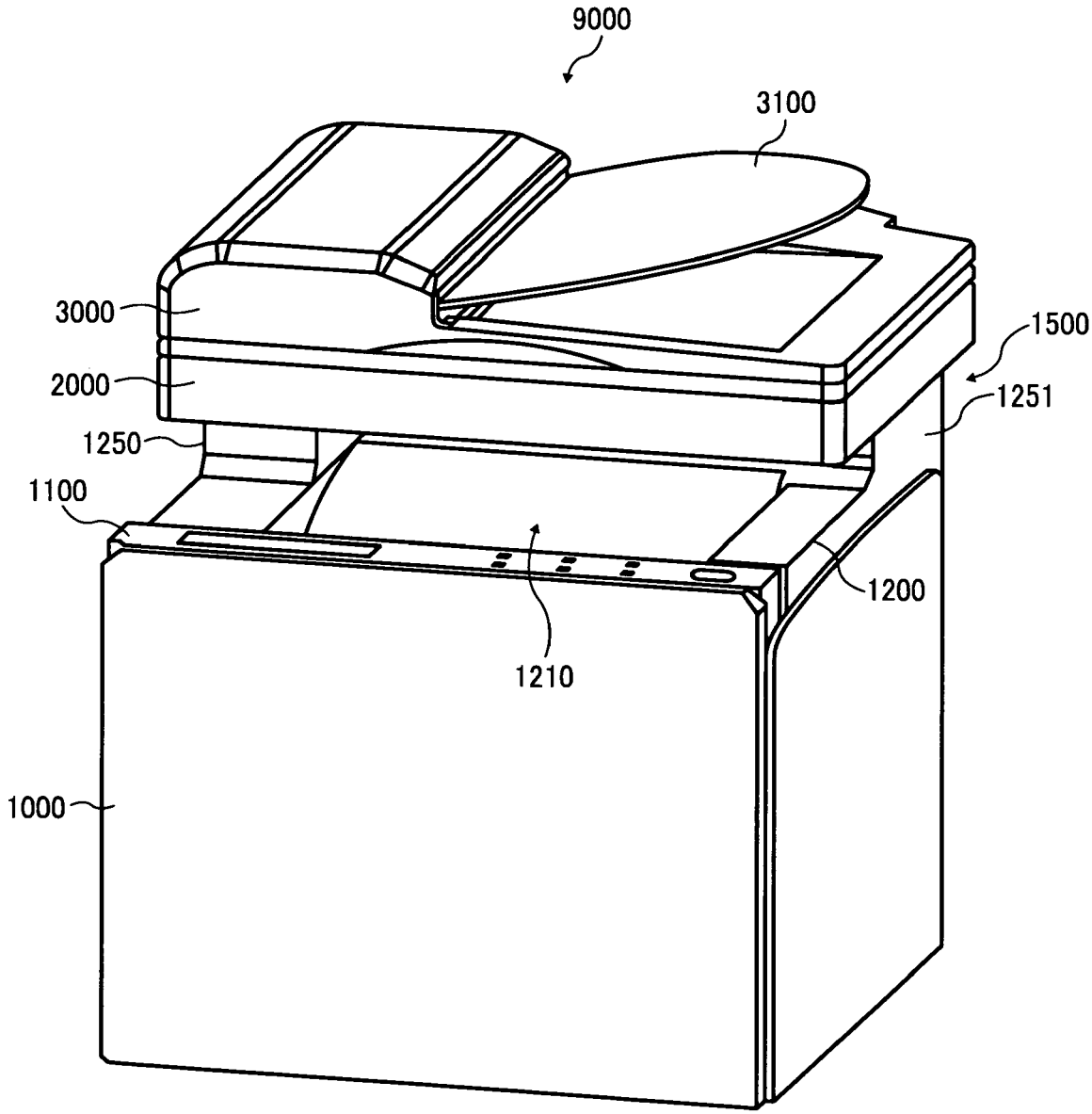
FIG. 1 is a perspective view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 2:
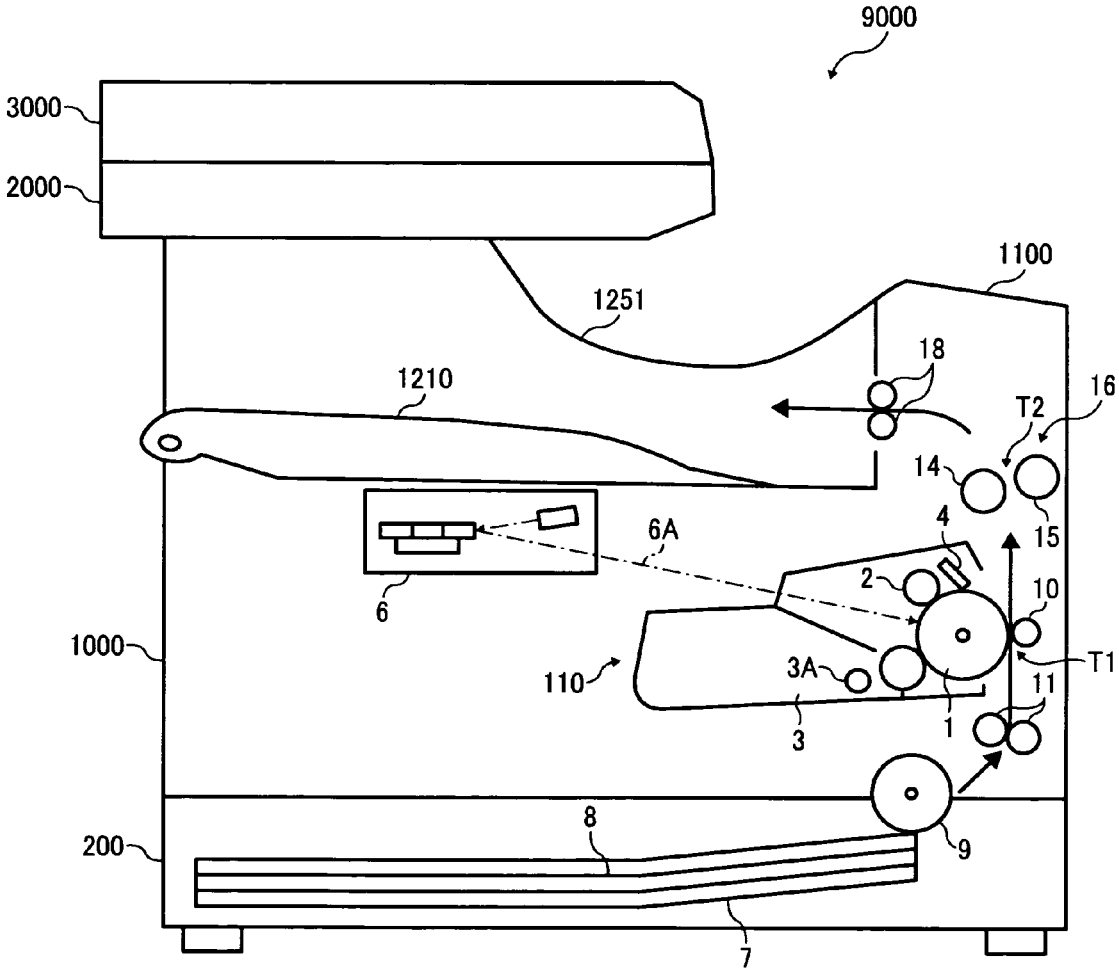
FIG. 2 is a sectional view (according to an example embodiment) of the image forming apparatus shown in FIG. 1.

Referring now to the drawings, wherein like reference numerals designate identical or corresponding parts throughout the several views, particularly to FIGS. 1 and 2, an image forming apparatus 9000 according to an example embodiment is explained.

FIG. 1 is a perspective view of the image forming apparatus 9000. The image forming apparatus 9000 includes a control panel 1100, an image forming device 1000, and/or an upper unit 1500. The upper unit 1500 includes an auto document feeder (ADF) 3000, a scanner 2000, bases 1250 and 1251, and/or an upper cover 1200. The ADF 3000 includes a tray 3100. The upper cover 1200 includes an output tray 1210.

FIG. 2 is a sectional view of the image forming apparatus 9000. The image forming device 1000 includes an optical writing unit 6, a process cartridge 110, a sheet supply unit 200, a registration roller pair 11, a transfer roller 10, a fixing device 16, and/or an output roller pair 18. The process cartridge 110 includes a photoconductor 1, a charger 2, a development device 3, and/or a cleaner 4. The development device 3 includes a development roller 3A. The sheet supply unit 200 includes a paper tray 7 and/or a feeding roller 9. The fixing device 16 includes a fixing roller 14 and/or a pressing roller 15.

As illustrated in FIG. 1, the image forming apparatus 9000 can be a copier, a facsimile machine, a printer, a plotter, a multifunction printer having at least one of copying, printing, scanning, plotter, and facsimile functions, or the like. According to this example embodiment, the image forming apparatus 9000 functions as a digital multifunction printer for forming an image on a recording medium by electrophotography.

The tray 3100 loads one or more original document sheets. When a user of the image forming apparatus 9000 operates the control panel 1100 to enter a command for copying a plurality of original document sheets placed on the tray 3100, the ADF 3000 automatically feeds the plurality of original document sheets one by one to the scanner 2000. Alternatively, the user may place an original document sheet on the scanner 2000.

The scanner 2000, serving as a scanner unit, is provided above the image forming device 1000. The scanner 2000 includes a moving body (not shown) including a light source (not shown) and a mirror (not shown). The moving body moves in a direction (e.g., a sub-scanning direction) perpendicular to a direction of conveyance of the original document sheet fed by the ADF 3000 to scan an image on the original document sheet passing or placed on an exposure glass (not shown) of the scanner 2000. The scanned image is sent to a CCD (charge-coupled device) via a mirror (not shown). The CCD reads the scanned image as an image signal. The image signal is digitized and subject to image processing. The processed image signal is sent to the image forming device 1000.

As illustrated in FIG. 2, in the image forming device 1000, the charger 2 uniformly charges a surface of the photoconductor 1 (e.g., a photoconductive drum) serving as an image carrier. The optical writing unit 6 (e.g., a light exposure optical system) writes an electrostatic latent image on the charged surface of the photoconductor 1. For example, in the optical writing unit 6, a semiconductor laser (not shown, e.g., a laser diode) emits a laser beam 6A corresponding to the processed image signal sent from the scanner 2000. A polygon mirror (not shown) rotates and deflects the laser beam 6A toward the photoconductor 1 via a lens and a mirror (not shown) provided on an optical path on which the laser beam 6A travels, such as a converging lens, a lens for correcting optical face tangle error generated by the polygon mirror, and a mirror for deflecting the laser beam 6A. Thus, an optical signal (e.g., the laser beam 6A) corresponding to image data generated by the scanner 2000 is written on the photoconductor 1.

The development device 3, serving as a development member, develops the electrostatic latent image with a developer (e.g., toner) to form a toner image on the photoconductor 1.

The sheet supply unit 200 is provided in a lower portion of the image forming device 1000. The sheet supply unit 200 includes the paper tray 7 and the feeding roller 9. The paper tray 7 loads transfer sheets 8 serving as a transfer medium. The feeding roller 9 feeds the transfer sheets 8 one by one from the paper tray 7 toward the registration roller pair 11 serving as a transfer medium conveyance member. For example, the feeding roller 9 separates an uppermost transfer sheet 8 from other transfer sheets 8 loaded on the paper tray 7 and feeds the uppermost transfer sheet 8 toward the registration roller pair 11. The registration roller pair 11 temporarily stops the transfer sheet 8 fed by the feeding roller 9.

The registration roller pair 11 feeds the transfer sheet 8 to a transfer nip T1 formed between the photoconductor 1 and the transfer roller 10 in synchronism with rotation of the photoconductor 1 at a time when a leading edge of the toner image formed on the photoconductor 1 and a leading edge of the transfer sheet 8 reach the transfer nip T1 almost simultaneously. At the transfer nip T1, the transfer roller 10 transfers the toner image from the photoconductor 1 onto the transfer sheet 8. After the transfer of the toner image, the cleaner 4 cleans the surface of the photoconductor 1.

The fixing device 16, serving as a fixing member, is provided in an upper portion of the image forming device 1000. In the fixing device 16, the fixing roller 14 and the pressing roller 15 pressingly contact each other to form a fixing nip T2. For example, the fixing roller 14 and the pressing roller 15 rotate and sandwich the transfer sheet 8 bearing the toner image conveyed on a conveyance path. A heater (not shown) is rotatably provided inside the fixing roller 14.

The output roller pair 18 is provided downstream from the fixing device 16 in a conveyance direction of the transfer sheet 8. The output roller pair 18 outputs the transfer sheet 8 passing the fixing nip T2 formed between the fixing roller 14 and the pressing roller 15 and thereby bearing the fixed toner image onto the output tray 1210 provided in an upper portion of the upper cover 1200 (depicted in FIG. 1).

As illustrated in FIG. 1, the bases 1250 and 1251 are provided on the upper cover 1200 in such a manner that the bases 1250 and 1251 protrude upward from the upper cover 1200 and the output tray 1210 is provided between the bases 1250 and 1251. The scanner 2000 is attached to the bases 1250 and 1251 in such a manner that a space is provided above the output tray 1210. Transfer sheets 8 fed by the output roller pair 18 (depicted in FIG. 2) are stacked in the space between the output tray 1210 and the scanner 2000.

Referring to FIG. 2, the following describes operations of the image forming apparatus 9000 having the above-described structure. The charger 2 uniformly charges the surface of the rotating photoconductor 1. The optical writing unit 6 forms an electrostatic latent image in a charged area (e.g., an image forming area) on the surface of the photoconductor 1 according to image data. The development roller 3A included in the development device 3 supplies a developer (e.g., toner) to the electrostatic latent image to make the electrostatic latent image visible as a toner image.

While the image forming device 1000 forms the toner image on the photoconductor 1, the feeding roller 9 feeds a transfer sheet 8 from the paper tray 7 toward the registration roller pair 11. When a leading edge of the transfer sheet 8 contacts a nip of the registration roller pair 11, the registration roller pair 11 temporarily stops rotating to stop the transfer sheet 8. The registration roller pair 11 resumes rotating to feed the transfer sheet 8 to the transfer nip T1 formed between the photoconductor 1 and the transfer roller 10 at a time when the toner image formed on the photoconductor 1 is transferred onto a proper position on the transfer sheet 8. After the toner image is transferred from the photoconductor 1 to the transfer sheet 8 at the transfer nip T1, a discharging brush (not shown) contacts and discharges the transfer sheet 8. The discharged transfer sheet 8, is mechanically separated from the photoconductor 1 and is sent to the fixing device 16.

In the fixing device 16, the fixing roller 14 and the pressing roller 15 sandwich the transfer sheet 8 and apply heat and pressure to the transfer sheet 8 to fix the toner image on the transfer sheet 8. The output roller pair 18 outputs the transfer sheet 8 bearing the fixed toner image onto the output tray 1210.

After the toner image formed on the photoconductor 1 passes the transfer nip T1, a cleaning blade (not shown) included in the cleaner 4 removes residual toner remaining on the surface of the photoconductor 1 from the surface of the photoconductor 1.

The conveyance path, on which the transfer sheet 8 is conveyed, extends upward via the nip of the registration roller pair 11, the transfer nip T1, and the fixing nip T2. Accordingly, the transfer sheet 8 is conveyed on the conveyance path in a substantially vertical direction. Thus, the image forming apparatus 9000 may have a compact size and may shorten a first print output time.

The photoconductor 1, the charger 2, the development device 3, and the cleaner 4 are integrated into the process cartridge 110. The process cartridge 110 is attachable to and detachable from the image forming apparatus 9000. For example, the photoconductor 1, the charger 2, the development device 3, and the cleaner 4 are disposed inside a single case (not shown) with a layout as illustrated in FIG. 2. When a plurality of elements including the charger 2 and the photoconductor 1 is integrated into the process cartridge 110, the plurality of elements may be replaced with new ones easily.

Figure 3:
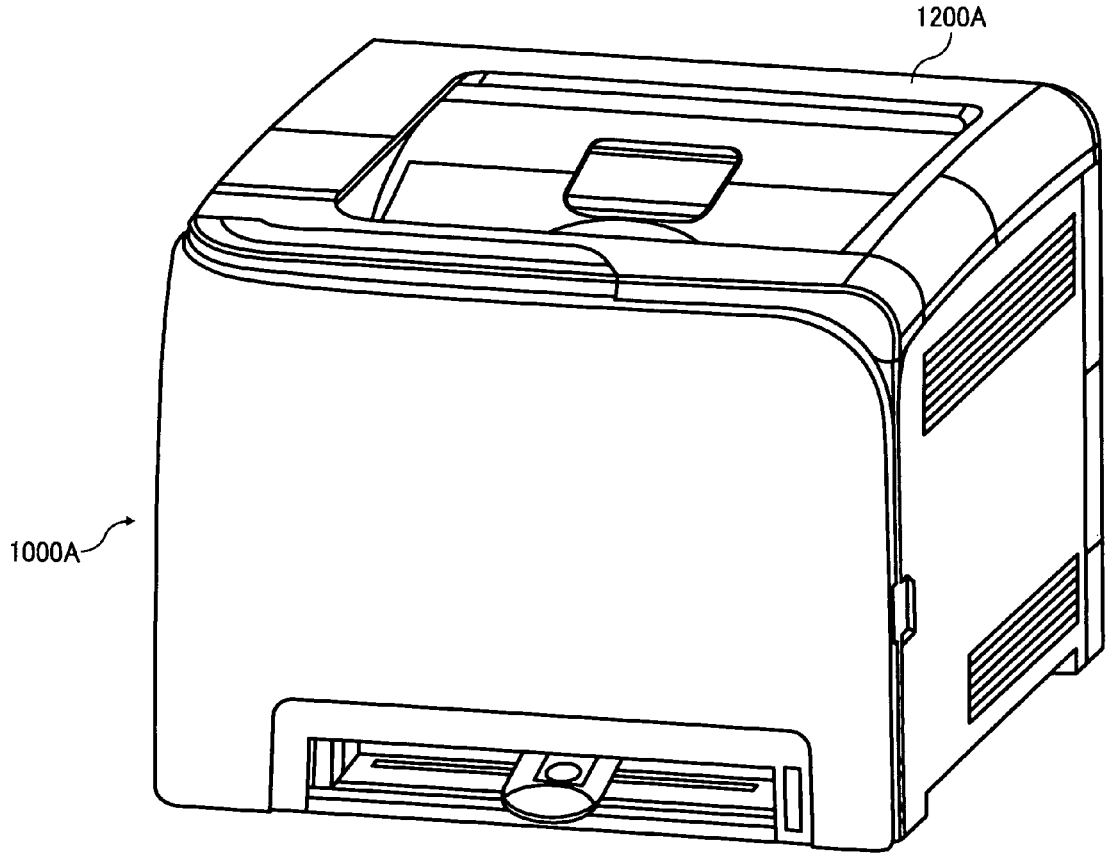
FIG. 3 is a perspective view of an image forming apparatus according to another example embodiment.

FIG. 3 is a perspective view of a printer 1000A serving as an image forming apparatus having a printer function. The printer 1000A includes an upper cover 1200A. The upper cover 1200A is provided on top of the printer 1000A.

Figure 4:
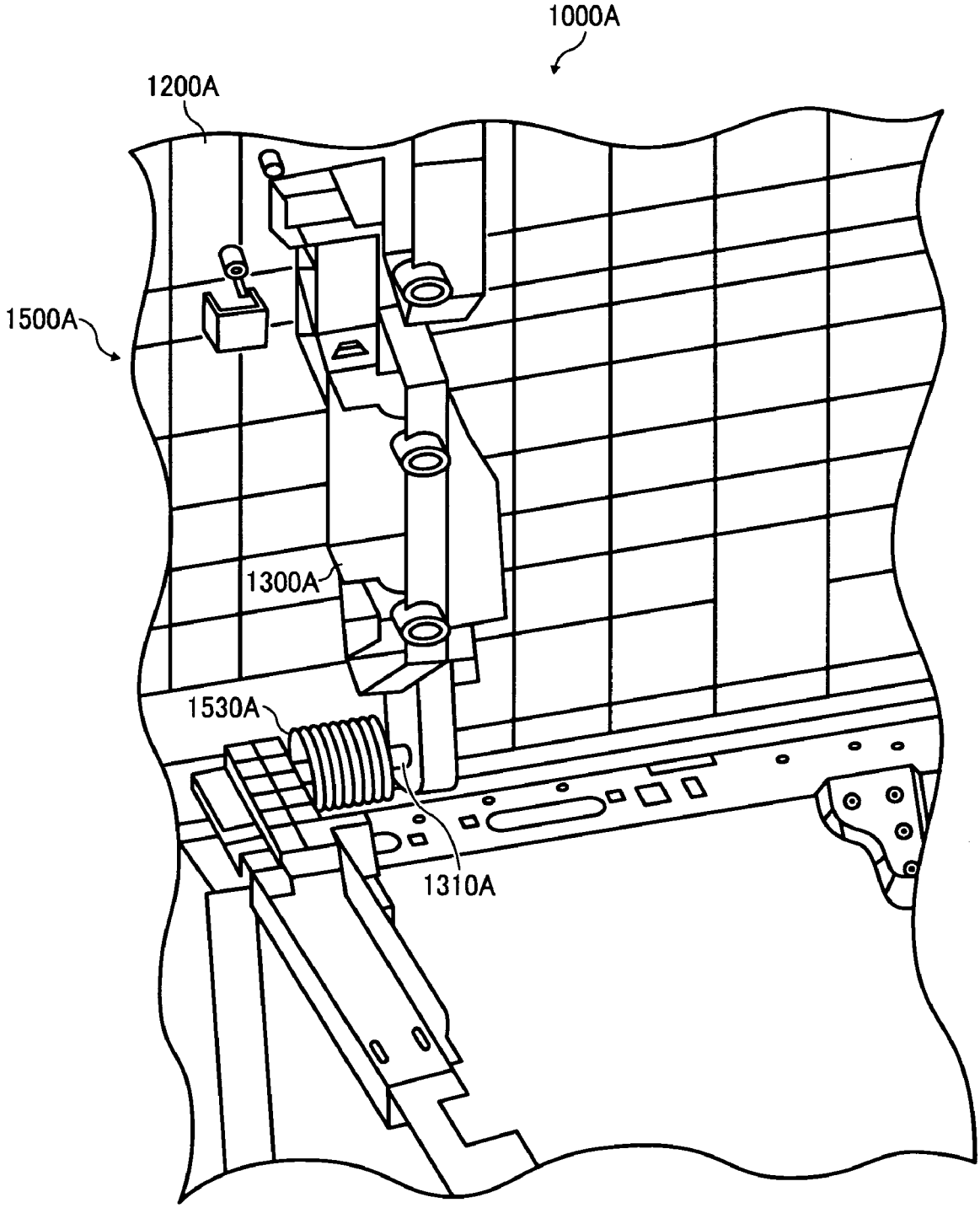
FIG. 4 is a partial perspective view (according to an example embodiment) of the image forming apparatus shown in FIG. 3 when an upper cover included in the image forming apparatus is opened.

FIG. 4 is a partial perspective view of the printer 1000A when the upper cover 1200A is opened. The printer 1000A further includes a shaft 1310A and/or an upper unit 1500A. The upper unit 1500A includes an upper frame 1300A. The upper frame 1300A includes a torsion spring 1530A.

The shaft 1310A penetrates a rear portion of the printer 1000A in a direction from left to right in FIG. 4 in parallel to a rear side of the printer 1000A, and supports the upper frame 1300A. The upper frame 1300A is provided in one end of the shaft 1310A in a longitudinal direction of the shaft 1310A and rotates about the shaft 1310A. Another upper frame (not shown, e.g., a right upper frame) is provided in another end of the shaft 1310A in the longitudinal direction of the shaft 1310A. The upper cover 1200A is connected to the upper frame 1300A and the right upper frame to form a single upper unit 1500A.

A light exposure optical system (not shown) is held between the upper frame 1300A and the right upper frame. The upper unit 1500A further includes a lock (not shown) for locking the upper unit 1500A when the upper unit 1500A is closed and a lock release lever (not shown) for releasing the lock.

The torsion spring 1530A is provided on a shaft (e.g., the shaft 1310A) of the upper frame 1300A. The torsion spring 1530A applies a force (e.g., torque) for opening the upper unit 1500A at a proper speed. When the lock is released, the force applied by the torsion spring 1530A springs up the upper unit 1500A slowly until the upper unit 1500A forms a maximum open angle. A torsion spring (not shown) equivalent to the torsion spring 1530A is provided on a shaft (e.g., the shaft 1310A) of the right upper frame, and provides a function equivalent to the function of the torsion spring 1530A.

Figure 5:
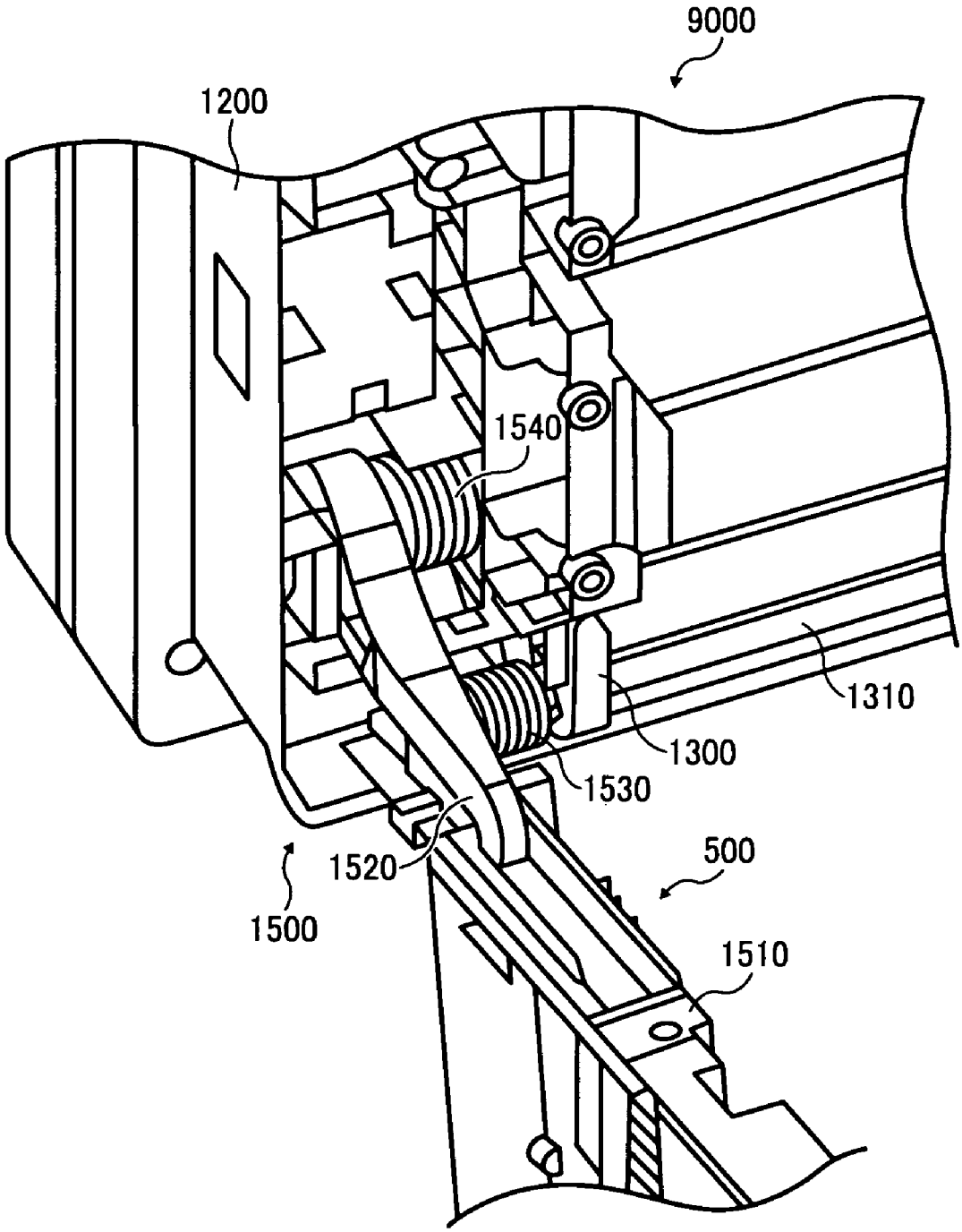
FIG. 5 is a partial perspective view (according to an example embodiment) of the image forming apparatus shown in FIG. 1 when an upper cover included in the image forming apparatus is opened.
Figure 6:
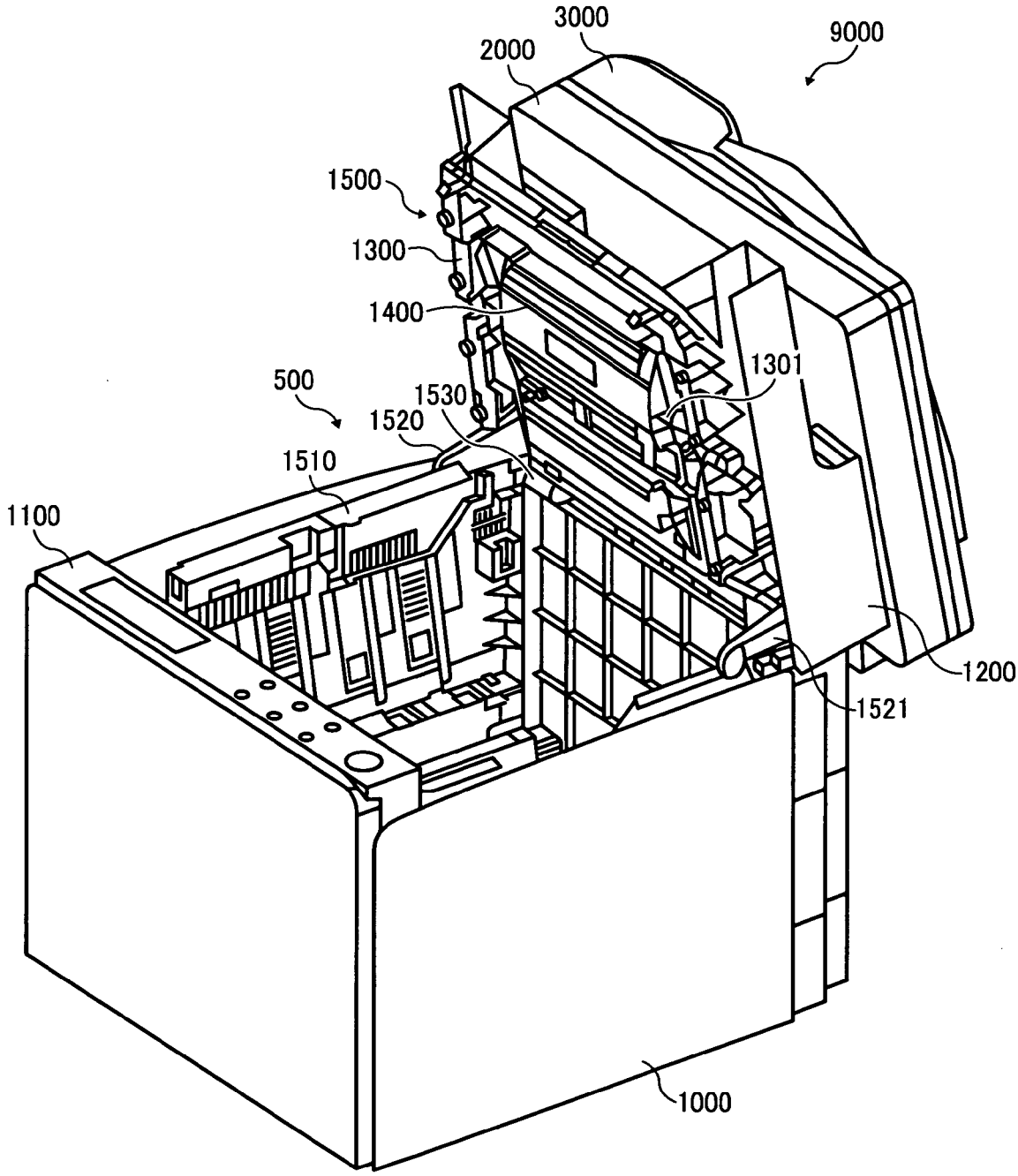
FIG. 6 is a perspective view (according to an example embodiment) of the image forming apparatus shown in FIG. 1 when an upper cover included in the image forming apparatus is opened.

FIG. 5 is a partial perspective view of the image forming apparatus 9000 shown in FIG. 1 when the upper cover 1200 is opened. FIG. 6 is a perspective view of the image forming apparatus 9000 shown in FIG. 1 when the upper cover 1200 is opened. As illustrated in FIG. 5, the image forming apparatus 9000 further includes a shaft 1310 and/or a damper 500. The damper 500 includes an arm 1520, a torsion spring 1540, and/or a slide rail 1510. The upper unit 1500 further includes an upper frame 1300. The upper frame 1300 includes a torsion spring 1530. As illustrated in FIG. 6, the upper unit 1500 further includes an upper frame 1301 and/or a slide lock switch 1400. The damper 500 further includes an arm 1521.

As illustrated in FIG. 5, the shaft 1310 penetrates a rear portion of the image forming apparatus 9000 in a direction from left to right in FIG. 5 in parallel to a rear side of the image forming apparatus 9000, and supports the upper frame 1300. The upper frame 1300 is provided in one end of the shaft 1310 in a longitudinal direction of the shaft 1310 and rotates about the shaft 1310. The upper frame 1301 (depicted in FIG. 6) is provided in another end of the shaft 1310 in the longitudinal direction of the shaft 1310. The upper cover 1200 is connected to the upper frame 1300 and the upper frame 1301 to form a single upper unit 1500.

A light exposure optical system (not shown) is held between the upper frame 1300 and the upper frame 1301. The upper unit 1500 further includes a lock (not shown) for locking the upper unit 1500 when the upper unit 1500 is closed and a lock release lever (not shown) for releasing the lock.

The torsion spring 1530 is provided on a shaft (e.g., the shaft 1310) of the upper frame 1300. A torsion spring (not shown) equivalent to the torsion spring 1530 is provided on a shaft (e.g., the shaft 1310) of the upper frame 1301.

As illustrated in FIG. 6, when the upper cover 1200 is opened (e.g., lifted), the scanner 2000 mounted on the upper cover 1200 via the bases 1250 and 1251 (depicted in FIG. 1) and the ADF 3000 mounted on the scanner 2000 are also lifted. Weight of the scanner 2000 and the ADF 3000 affect rotation of the upper unit 1500. Therefore, a damper is needed to help a user of the image forming apparatus 9000 open and close the upper unit 1500 with a small force, so as to prevent the upper unit 1500 from lowering at a speed accelerated by the weight of the scanner 2000 and the ADF 3000 when the user gets his or her hand off the upper unit 1500 and thereby injuring the user, or to prevent the upper unit 1500 from receiving impact and thereby being damaged.

When the upper cover 1200 of the upper unit 1500 is configured to engage with the damper, the damper may be designed and added to the image forming apparatus 9000 or the printer 1000A (depicted in FIG. 3) without modifying a body (e.g., the image forming device 1000) so as to cope with weight increase caused by the scanner 2000 and/or the ADF 3000 mounted on the upper cover 1200. Consequently, a number of design processes and extra parts may be reduced. Further, the body may be shared by the image forming apparatus 9000 and the printer 1000A, preventing increase of assembly processes for assembling the body.

Figure 7:
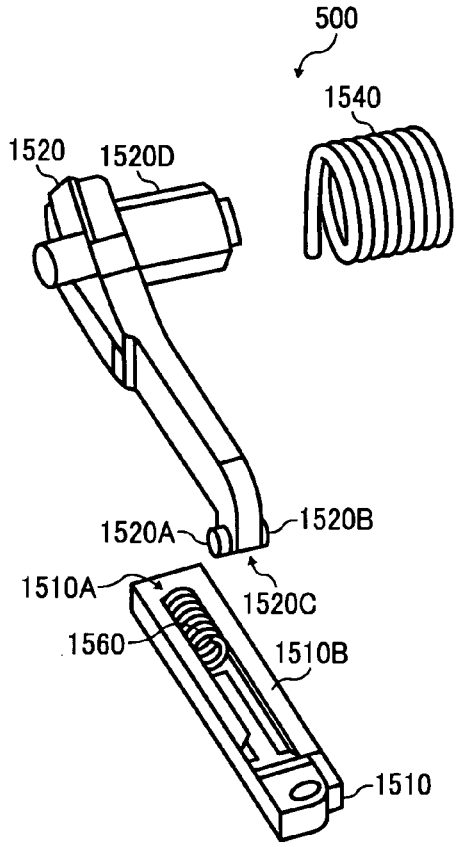
FIG. 7 is a perspective view (according to an example embodiment) of a damper included in the image forming apparatus shown in FIG. 6.

Referring to FIGS. 5 to 7, the following describes the damper 500 as one example of the damper installed in the image forming apparatus 9000 (depicted in FIG. 1) or the printer 1000A (depicted in FIG. 3). According to this example embodiment, the damper 500 is installed in the image forming apparatus 9000. FIGS. 5 to 7 illustrate the damper 500 provided in a left portion of the image forming apparatus 9000. However, another damper equivalent to the damper 500 may be provided in a right portion of the image forming apparatus 9000. Since the another damper provided in the right portion of the image forming apparatus 9000 has a structure equivalent to the structure of the damper 500, the description of the another damper is omitted.

As illustrated in FIG. 7, the damper 500 further includes an elastic member 1560. The arm 1520 includes a rotary shaft 1520D, an end 1520C, and/or heads 1520A and 1520B. The slide rail 1510 includes an end 1510A and/or a roof 1510B.

As illustrated in FIG. 5, the upper cover 1200 rotatably supports the arm 1520. As illustrated in FIG. 7, the arm 1520 includes the rotary shaft 1520D in one end of the arm 1520 and the torsion spring 1540 is provided on the rotary shaft 1520D of the arm 1520. The slide rail 1510 is provided in a frame of a body including the image forming device 1000 and the control panel 1100 (depicted in FIG. 6).

As illustrated in FIG. 7, the end 1520C is provided in another end of the arm 1520 at which the rotary shaft 1520D is not provided, and slides in the slide rail 1510. The end 1510A of the slide rail 1510 engages with the heads 1520A and 1520B of the arm 1520. The elastic member 1560 is provided on the end 1510A of the slide rail 1510. One end of the torsion spring 1540 engages with the arm 1520 to apply torque for rotating the arm 1520. Another end of the torsion spring 1540 engages with the upper cover 1200 (depicted in FIG. 5).

The heads 1520A and 1520B protrude from the end 1520C of the arm 1520, which slides in the slide rail 1510, to form a key-like shape. The heads 1520A and 1520B have a cylindrical shape and protrude toward left and right from the arm 1520. The roof 1510B has a roof-like shape and holds the heads 1520A and 1520B in the slide rail 1510. Thus, when the heads 1520A and 1520B slide in the slide rail 1510, the roof 1510B prevents the arm 1520 from dropping out of the slide rail 1510. Moreover, when the heads 1520A and 1520B reach the end 1510A of the slide rail 1510, the heads 1520A and 1520B of the arm 1520 engage with the slide rail 1510 to regulate a maximum open angle of the upper cover 1200 (depicted in FIG. 5). Thus, even when a load is further applied to the upper cover 1200 after the upper cover 1200 is lifted up to the maximum open angle, a force may not be applied to the roof 1510B of the slide rail 1510 further.

When the upper cover 1200 is almost closed, the torsion spring 1540 presses the end 1520C of the arm 1520 downward toward the body (e.g., the image forming device 1000 depicted in FIG. 6) of the image forming apparatus 9000 (depicted in FIG. 6). Accordingly, the upper unit 1500 (depicted in FIG. 6) obtains torque in an upward direction. Thus, the torsion spring 1540 provides a force (e.g., torque) for causing the upper unit 1500 to be lifted easily when the user opens the upper unit 1500. When the user closes the upper unit 1500, the torsion spring 1540 provides a force for absorbing shock. The force applied by the torsion spring 1540 is amplified according to a ratio between a distance D1 between the rotary shaft 1520D of the arm 1520 and a rotary shaft of the upper unit 1500 and a distance D2 between the rotary shaft 1520D of the arm 1520 and a contact point at which the arm 1520 slides in the slide rail 1510. The distances D1 and D2 are parallel to a slide surface on which the heads 1520A and 1520B slide. Therefore, the torsion spring 1540 provided on the rotary shaft 1520D of the arm 1520 may provide a damper function improved compared to a torsion spring provided on the rotary shaft of the upper unit 1500. Namely, the torsion spring 1540 provided on the rotary shaft 1520D of the arm 1520 may apply a force (e.g., torque) equivalent to a force (e.g., torque) applied by the torsion spring provided on the rotary shaft of the upper unit 1500 at decreased costs.

As the upper cover 1200 rotates, a relative angle between the upper cover 1200 and the arm 1520 changes. Therefore, as a center of gravity of the upper unit 1500 moves, a force for lifting the upper unit 1500 may be changed as needed. The end 1520C of the arm 1520 moves in the slide rail 1510. Therefore, the end 1520C may obtain a force in a direction perpendicular to the slide surface on which the end 1520C slides under a small friction. Thus, the damper 500 may regulate a force for opening and closing the upper unit 1500 while providing smooth handling of the upper unit 1500 for the user. Alternatively, friction may be applied to a slide surface in the slide rail 1510 to strengthen the damper function.

As the upper unit 1500 is opened (e.g., lifted) to form a reference angle, the center of gravity of the upper unit 1500 reaches a position above the rotary shaft of the upper unit 1500 in a vertical direction. Namely, when the upper unit 1500 forms the reference angle or an angle greater than the reference angle, weight of the upper unit 1500 generates a force for rotating the upper unit 1500 toward a rear side of the image forming apparatus 9000. Accordingly, weight of the upper unit 1500 including the scanner 2000 and the ADF 3000 (depicted in FIG. 6) may rotate the upper unit 1500 toward the rear side of the image forming apparatus 9000 quickly, damaging a person and property behind the image forming apparatus 9000 or damaging the upper unit 1500. To address those problems, the elastic member 1560 eases acceleration of moving speed at which the end 1520C of the arm 1520 moves in the slide rail 1510, and the end 1520C contacts the end 1510A of the slide rail 1510 to regulate a maximum open angle formed by the upper unit 1500.

The elastic member 1560 includes a compression spring, urethane elastomer, a foam material, a rubber, and an oil damper. Among those, the compression spring, which provides a long stroke at a decreased cost, may be preferably used. The compression spring provided in the slide rail 1510 has a diameter larger than a gap between portions of the roof 1510B of the slide rail 1510 opposing each other. Thus, the compression spring may not drop out of the slide rail 1510. A natural angle formed by the torsion spring 1540 may be set near an open angle at which the center of gravity of the upper unit 1500 is above the rotary shaft of the upper unit 1500 in the vertical direction. Accordingly, when the upper unit 1500 is lifted to form an angle larger than the natural angle, the torsion spring 1540 generates a force (e.g., torque) in a direction in which the heads 1520A and 1520B of the arm 1520 sliding in the slide rail 1510 press the roof 1510B of the slide rail 1510. Namely, a force is applied to the upper unit 1500 in a direction preventing the upper unit 1500 from rotating toward the rear side of the image forming apparatus 9000.

When the damper 500 is provided in the image forming apparatus 9000, a mechanism occupying a wide space is not needed inside the frame of the body of the image forming apparatus 9000. Accordingly, the image forming apparatus 9000 may have a simple structure. The damper 500 may be installed in any image forming apparatus regardless of exterior and size.

The rotary shaft 1520D of the arm 1520 and the torsion spring 1540 may be provided inside the base 1250 (depicted in FIG. 1) on which the scanner 2000 (depicted in FIG. 1) is attached. In this case, size of a space in which the torsion spring 1540 is provided is not restricted and thereby a large torsion spring 1540 may be placed inside the base 1250. Moreover, the torsion spring 1540 is not exposed to the user of the image forming apparatus 9000 and consequently hair of the user may not be caught and entangled in the torsion spring 1540.

As illustrated in FIG. 1, the damper 500 (depicted in FIG. 7) having the above-described structure rotates the upper unit 1500. The upper unit 1500 includes the upper cover 1200 including the output tray 1210, the scanner 2000 mounted on the upper cover 1200 via the bases 1250 and 1251, and the ADF 3000 mounted on the scanner 2000. Therefore, a single action of opening the upper unit 1500 performed by the user may expose an interior of the image forming apparatus 9000 as illustrated in FIG. 6. Thus, the user may easily replace elements included in the image forming device 1000 with new ones.

When the damper 500 is installed in an image forming apparatus without the ADF 3000, a part of the damper 500 may be removed to provide a balanced structure, preventing use of extra elements and reducing manufacturing costs. For example, as illustrated in FIG. 7, the torsion spring 1540 may be provided on the rotary shaft 1520D of the arm 1520 but not provided on a rotary shaft of the arm 1521 (depicted in FIG. 6). Alternatively, a spring shared by the damper 500 and the body of the image forming apparatus may be modified or configuration of the spring, may be adjusted. The torsion spring 1540 left on the one end of the rotary shaft 1520D of the arm 1520 may be provided near the center of gravity of the upper unit 1500 (depicted in FIG. 5) to provide a balanced force for lifting the upper unit 1500.

According to this example embodiment, the torsion spring 1540 is provided on the rotary shaft 1520D of the arm 1520. Alternatively, a torque limiter using a frictional force or a damper mechanism (e.g., an oil damper) may be provided in the rotary shaft 1520D of the arm 1520 so that the upper unit 1500 may be opened and closed more stably and safely without occupying a larger space.

Figure 8:
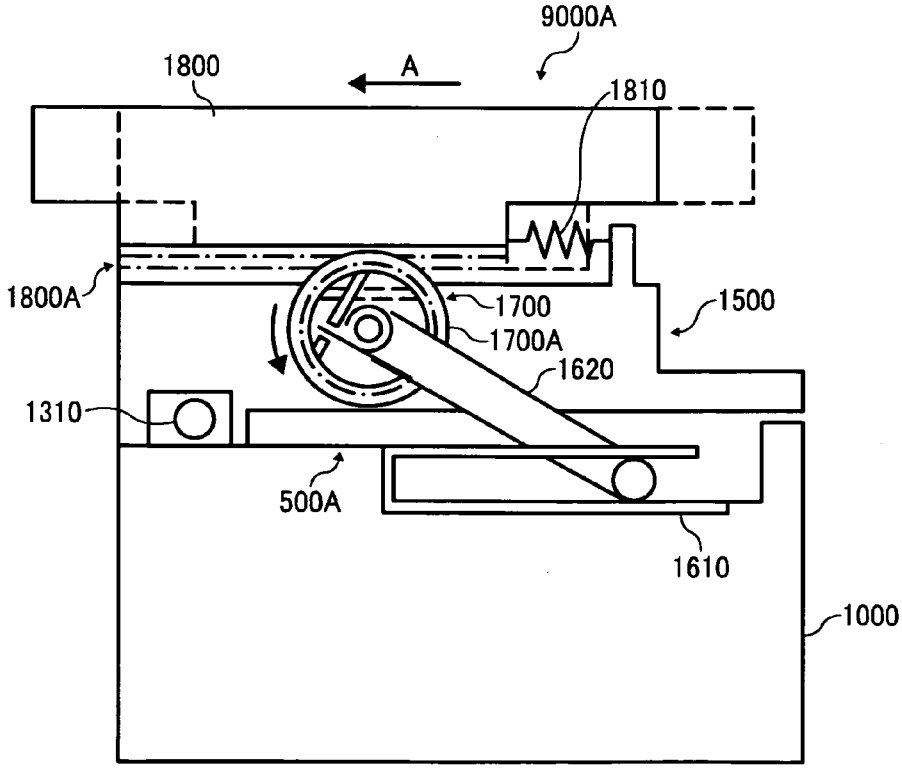
FIG. 8 is a sectional view of an image forming apparatus according to yet another example embodiment.

Referring to FIG. 8, the following describes an image forming apparatus 9000A according to another example embodiment. FIG. 8 is a sectional view of the image forming apparatus 9000A. The image forming apparatus 9000A includes the image forming device 1000, the shaft 1310, the upper unit 1500, a slide portion 1800, a damper 500A, and/or an elastic member 1810. The slide portion 1800 includes a gear 1800A. The damper 500A includes an arm 1620, a slide rail 1610, and/or a support member 1700. The support member 1700 includes a gear 1700A.

The slide portion 1800 is mounted on the upper unit 1500 and includes a scanner. When the slide portion 1800 including a heavy device such as the scanner slides on the upper unit 1500, an angular distribution of a rotation moment (e.g., torque) needed to open and close the upper unit 1500 changes. Therefore, a damper having a configuration optimized before the slide portion 1800 starts sliding may not provide a proper damper performance. To address this problem, increased load torque may be constantly applied to the upper unit 1500 to suppress acceleration of moving speed of the upper unit 1500. However, a user of the image forming apparatus 9000A needs to open and close the upper unit 1500 with a larger force. To address this problem, the damper 500A has a following structure to provide a proper damper performance even after the slide portion 1800 starts sliding.

Figure 9:
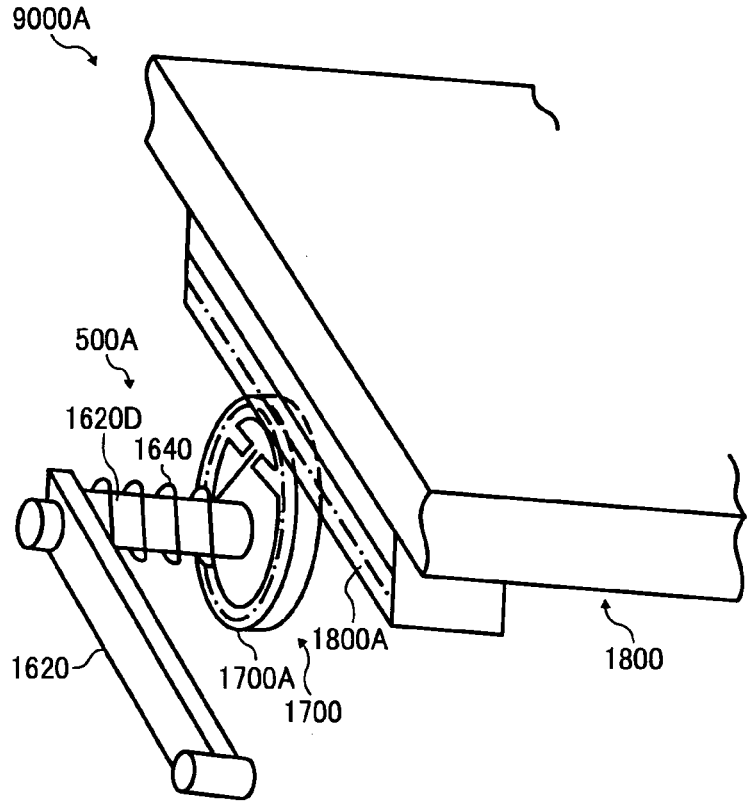
FIG. 9 is a perspective view (according to an example embodiment) of a damper included in the image forming apparatus shown in FIG. 8.

Referring to FIGS. 8 and 9, the following describes the damper 500A. FIG. 9 is a perspective view of the damper 500A. The damper 500A further includes a rotary shaft 1620D and/or a torsion spring 1640.

The arm 1620 is provided on the rotary shaft 1620D. One end of the torsion spring 1640, serving as a torque generation member, is supported by the arm 1620 and another end of the torsion spring 1640 is supported by the support member 1700. The support member 1700 is provided on the rotary shaft 1620D and rotates coaxially with the arm 1620. The gear 1700A is provided in a circumferential direction of the support member 1700. The arm 1620 includes a slide surface sliding in the slide rail 1610 (depicted in FIG. 8). The damper 500A having the above-described structure absorbs shock generated when the upper unit 1500 (depicted in FIG. 8) is opened and closed with a principle common to the damper 500 (depicted in FIG. 7).

As illustrated in FIG. 8, when the slide portion 1800 including the heavy scanner slides in a direction A toward a rear side of the image forming apparatus 9000A, a center of gravity of the upper unit 1500 moves as the upper unit 1500 is opened (e.g., lifted). Accordingly, the upper unit 1500 does not rotate toward a front side of the image forming apparatus 9000A (e.g., toward right in FIG. 8), but tends to rotate toward the rear side of the image forming apparatus 9000A (e.g., toward left in FIG. 8). To correct such tendency, when the slide portion 1800 mounted on the upper unit 1500 slides toward the rear side of the image forming apparatus 9000A, the gear 1800A rotates the gear 1700A. The gear 1800A serves as a rack provided on a bottom surface of the slide portion 1800 in a slide direction in which the slide portion 1800 slides. The gear 1700A is provided in a circumferential direction of the support member 1700.

As illustrated in FIG. 9, the support member 1700 fixes an angle formed by the upper unit 1500 (depicted in FIG. 8) and the torsion spring 1640 provided on the rotary shaft 1620D of the arm 1620. Thus, when the upper unit 1500 is closed, torsion of the torsion spring 1640 is loosened. Namely, decreased torque is applied to the arm 1620 when the upper unit 1500 is closed. Accordingly, when the user opens and closes the upper unit 1500, a torque angle of the torsion spring 1640 is switched to a close direction at a decreased angle as the upper unit 1500 is closed. Consequently, even after the slide portion 1800 starts sliding, the damper 500A may provide an optimized damper performance equivalent to the optimized damper performance that the damper 500A provides before the slide portion 1800 starts sliding. Accordingly, the user needs not move the upper unit 1500 with an increased force.

To adjust an amount of change of the angle of the torsion spring 1640 in accordance with an amount of slide of the slide portion 1800, a diameter of the gear 1700A provided on the support member 1700 for supporting the torsion spring 1640 may be changed. However, when the change of the diameter of the gear 1700A is restricted due to limited space, an amount of change of the angle of the torsion spring 1640 may be adjusted via an idler gear (not shown). In this case, a direction of rotation of the gear 1700A may change according to a number of gears. Therefore, the adjustment needs to be performed by considering such change of the direction of rotation of the gear 1700A.

Figure 10:
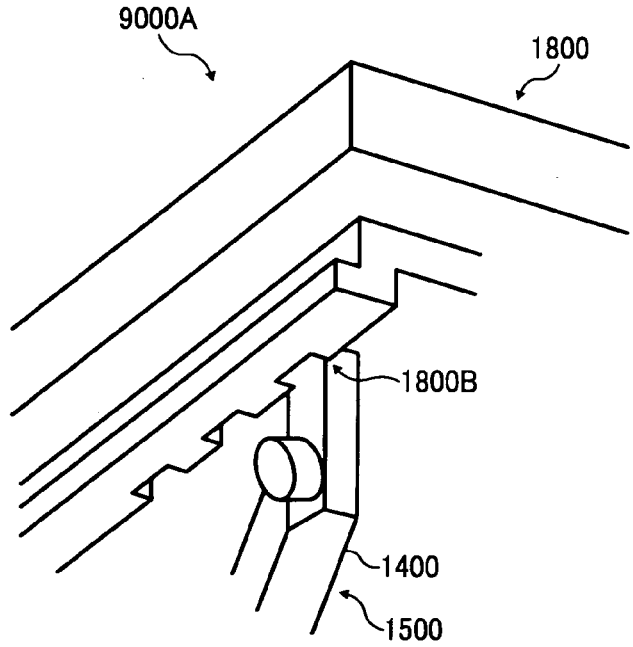
FIG. 10 is a perspective view (according to an example embodiment) of a slide lock switch included in the image forming apparatus shown in FIG. 8.

As illustrated in FIG. 10, the image forming apparatus 9000A further includes the slide lock switch 1400 and/or a slide lock engaging portion 1800B.

The slide lock engaging portion 1800B is provided on the slide portion 1800 and engages with the slide lock switch 1400 to lock the slide portion 1800. When the upper unit 1500 is closed, the torsion spring 1640 (depicted in FIG. 9) generates torque in a direction for sliding the slide portion 1800 toward the rear side of the image forming apparatus 9000A. Therefore, when the lock is released, the slide portion 1800 automatically slides toward the rear side of the image forming apparatus 9000A. In this case, the user may need to apply an increased force to move the slide portion 1800 toward the front side of the image forming apparatus 9000A. To address this problem, the elastic member 1810 (depicted in FIG. 8), such as a compression spring, a tension spring, or a torsion spring, is attached to the slide portion 1800 to apply a resistance load to the slide portion 1800. Thus, the elastic member 1810 may adjust automatic slide of the slide portion 1800 when the lock is released and a force needed for the user to move the slide portion 1800. According to this example embodiment, a tension spring is used as the elastic member 1810.

Figure 11:
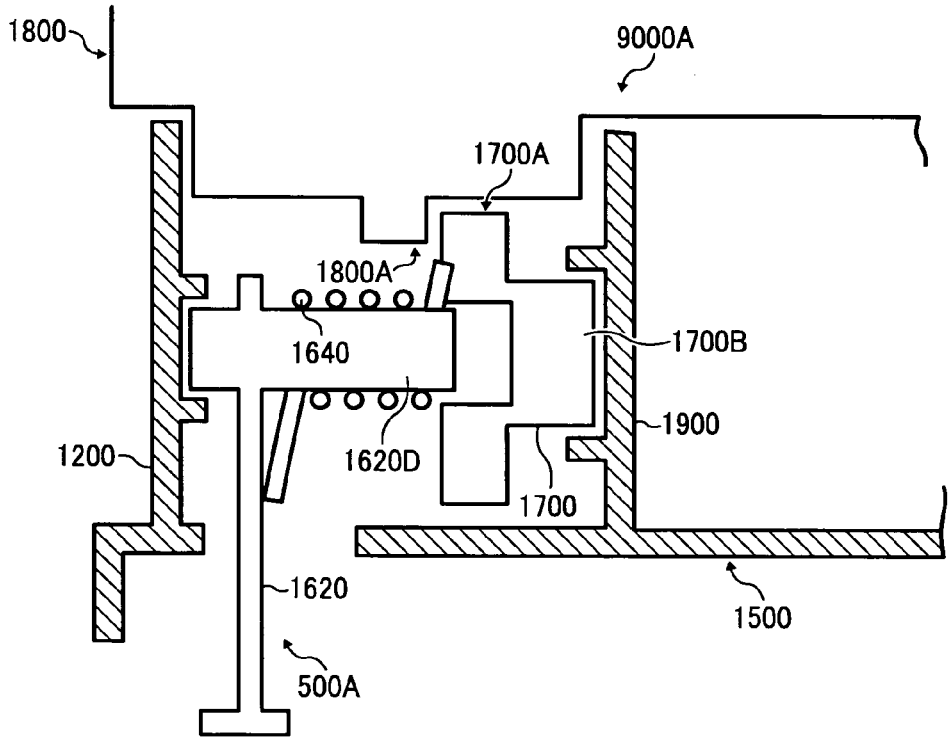
FIG. 11 is a sectional view (according to an example embodiment) of a load receiver and a load receiver engaging portion included in the image forming apparatus shown in FIG. 8 engaging with each other.
Figure 12:
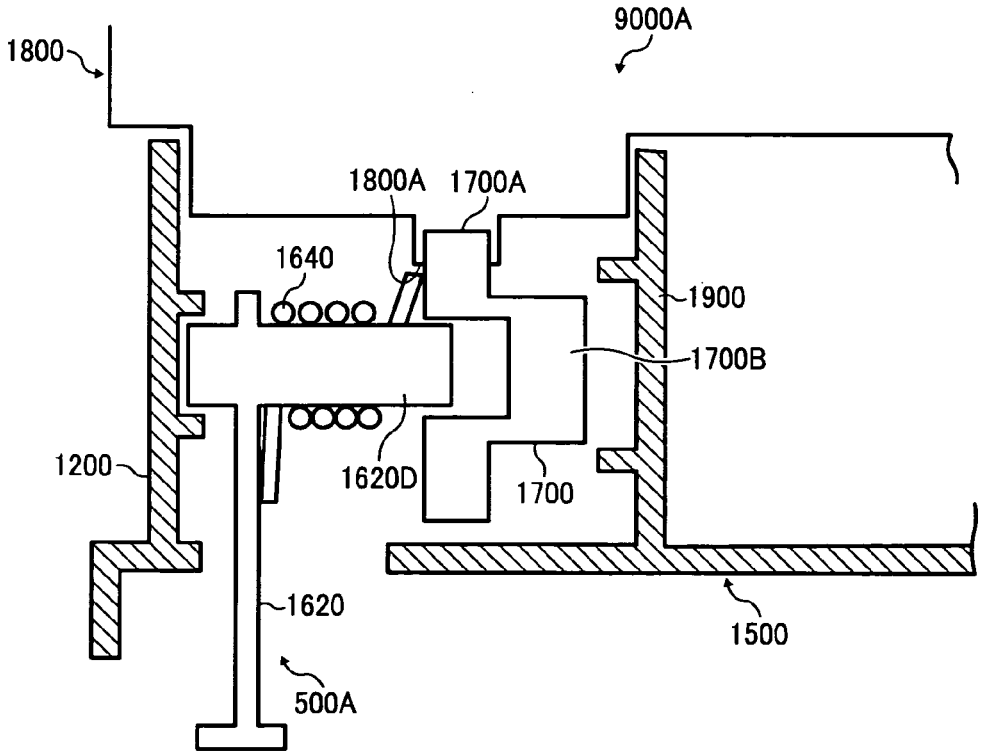
FIG. 12 is a sectional view (according to an example embodiment) of the load receiver and the load receiver engaging portion shown in FIG. 11 not engaging with each other.

As illustrated in FIGS. 11 and 12, the image forming apparatus 9000A further includes the upper cover 1200. The support member 1700 further includes a load receiver 1700B. The upper unit 1500 includes a load receiver engaging portion 1900.

The support member 1700 for supporting the torsion spring 1640 is configured to move in a thrust direction and an elastic force of the torsion spring 1640 applied in the thrust direction pushes the support member 1700 toward an outer side of the support member 1700 (e.g., a side opposite to an inner side faced by the torsion spring 1640). The load receiver 1700B is provided on the outer side of the support member 1700 and engages with the upper unit 1500. The load receiver engaging portion 1900 is provided in the upper unit 1500 to correspond to the load receiver 1700B and engages with the load receiver 1700B.

FIG. 11 illustrates a normal state in which the load receiver 1700B engages with the load receiver engaging portion 1900 to form a rotation preventing portion for preventing the support member 1700 from rotating.

Figure 13A:
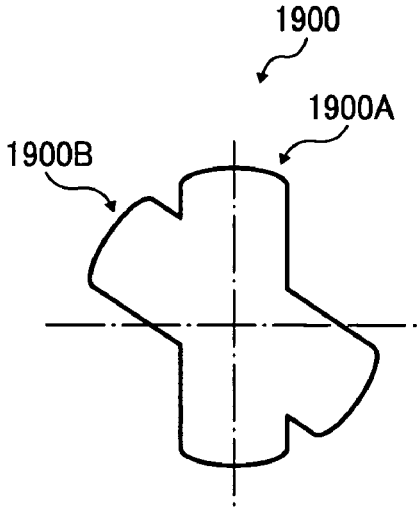
FIG. 13A is a schematic view (according to an example embodiment) of the load receiver engaging portion shown in FIG. 11.
Figure 13B:
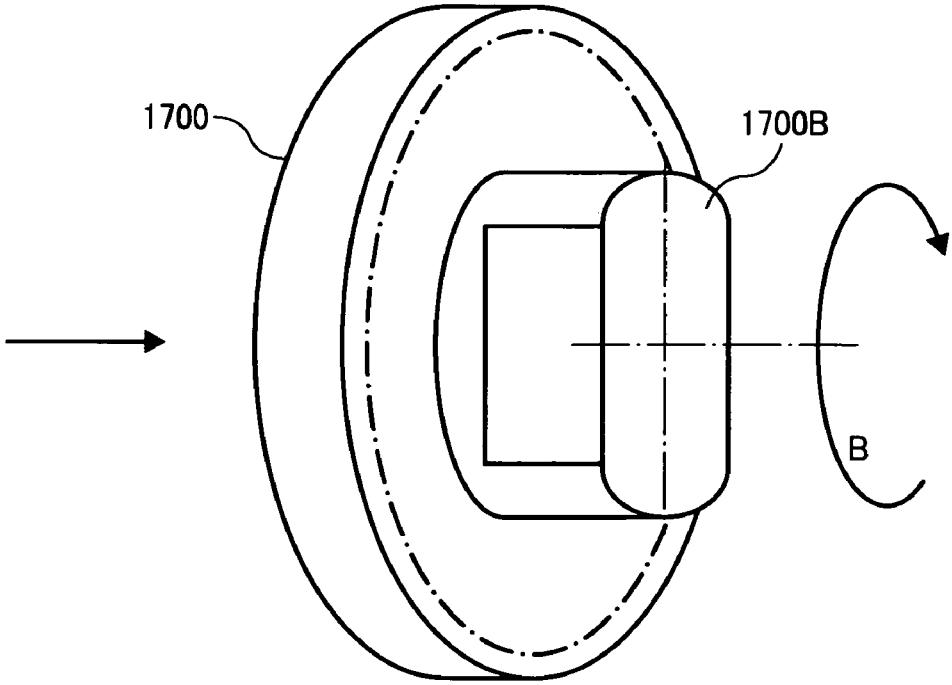
FIG. 13B is a perspective view (according to an example embodiment) of the load receiver shown in FIG. 11.

FIG. 13A illustrates the load receiver engaging portion 1900. The load receiver engaging portion 1900 includes grooves 1900A and 1900B. FIG. 13B is a perspective view of the support member 1700.

In the normal state, the groove 1900A (depicted in FIG. 13A) provided in the load receiver engaging portion 1900 engages with the load receiver 1700B (depicted in FIG. 11) to prevent the support member 1700 (depicted in FIG. 11) from rotating. In this state, as illustrated in FIG. 11, the gear 1700A of the support member 1700 does not engage with the gear 1800A of the slide portion 1800.

Figure 14:
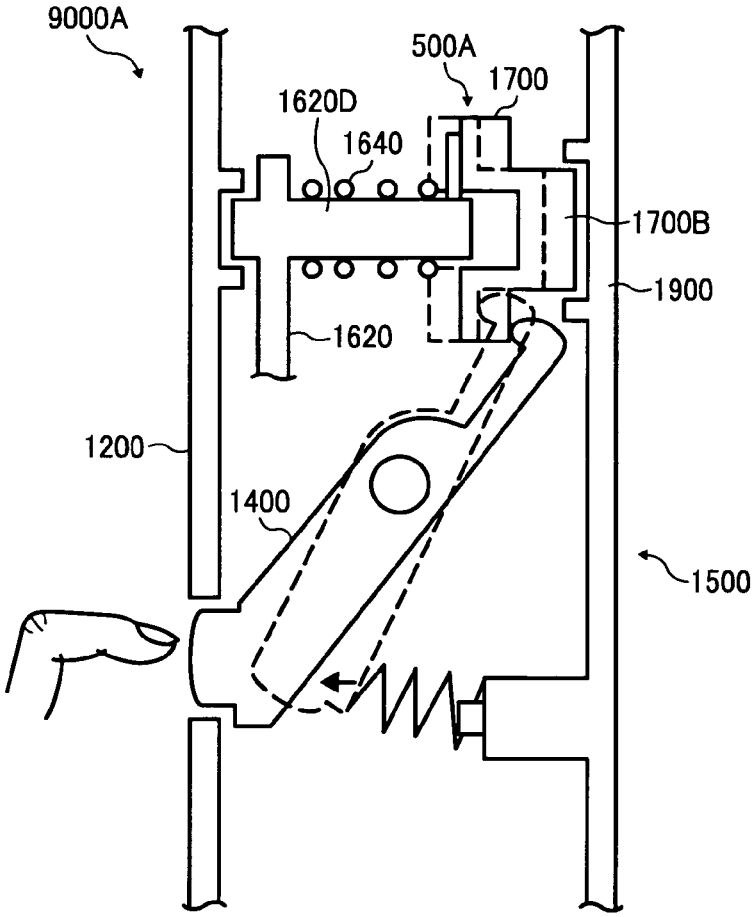
FIG. 14 is a sectional view (according to an example embodiment) of the slide lock switch shown in FIG. 10 used as a clutch.

As illustrated in FIG. 14, a part of the slide lock switch 1400 may serve as a clutch for moving the support member 1700 in the thrust direction so that the gear 1700A of the support member 1700 engages with the gear 1800A of the slide portion 1800, as illustrated in FIG. 12. For example, when the slide portion 1800 slides (e.g., when the slide lock switch 1400 depicted in FIG. 14 is pushed), the gear 1700A engages with the gear 1800A. Consequently, the support member 1700 rotates in a rotating direction B, as illustrated in FIG. 13B. As illustrated in FIG. 11, when the slide lock switch 1400 (depicted in FIG. 14) is not pushed, engagement of the gear 1700A with the gear 1800A is released. Accordingly, the load receiver 1700B of the support member 1700 engages with the groove 1900B (depicted in FIG. 13A) of the load receiver engaging portion 1900 of the upper unit 1500 to suppress rotation of the support member 1700. With the above-described structure, when the upper unit 1500 is opened and closed, a load is not applied to the gear 1700A but the load receiver 1700B receives the load, preventing damage to the gear 1700A and transmission of power, which may move the slide portion 1800, to the slide portion 1800 when the upper unit 1500 is opened.

Figure 15:
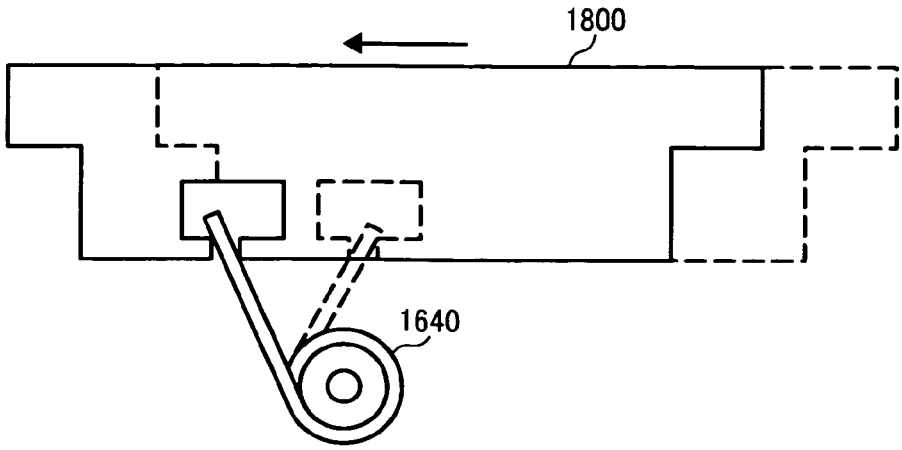
FIG. 15 is a sectional view (according to an example embodiment) of a modified example of the damper shown in FIG. 9.

According to this example embodiment, the gears 1700A and 1800A adjust an amount of movement of the support member 1700 to easily control an amount of slide of the slide portion 1800 and an amount of change of the angle formed by the torsion spring 1640. Alternatively, the support member 1700 may not be provided and the slide portion 1800 may directly support an arm of the torsion spring 1640, as illustrated in FIG. 15, providing a simpler structure without adding an element.

Figure 16A:
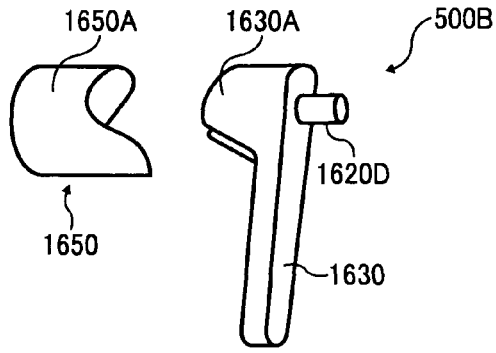
FIG. 16A is a perspective view (according to an example embodiment) of another modified example of the damper shown in FIG. 9.

Referring to FIG. 16A, the following describes a damper 500B according to yet another example embodiment. The damper 500B includes the rotary shaft 1620D, an arm 1630, and/or a counter cam 1650. The arm 1630 includes a cam 1630A. The counter cam 1650 includes a cam 1650A.

The cam 1630A and the counter cam 1650 including the cam 1650A serve as a torque generator provided on the rotary shaft 1620D of the arm 1630. The cam 1630A is provided on the arm 1630 in a thrust direction.

Figure 16B:
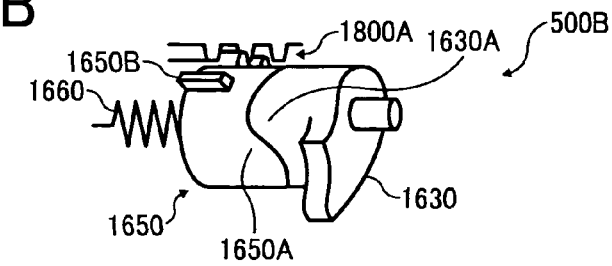
FIG. 16B is a perspective view (according to an example embodiment) of the damper shown in FIG. 16A when an upper unit included in the image forming apparatus shown in FIG. 8 is opened by about 40 degrees.

FIG. 16B illustrates the damper 500B when the upper unit 1500 (depicted in FIG. 8) is opened to form an angle of about 40 degrees with respect to a horizontal plane. The damper 500B further includes a gear 1650B and/or an elastic member 1660.

The gear 1650B is provided in a circumferential direction of the counter cam 1650 provided on the rotary shaft 1620D (depicted in FIG. 16A) of the arm 1630.

Figure 17:
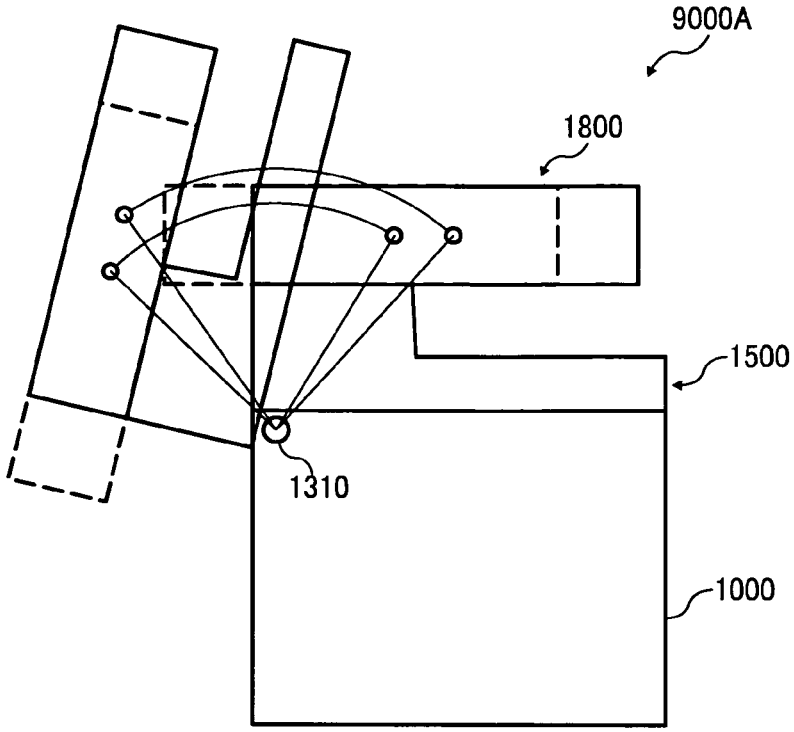
FIG. 17 is a sectional view (according to an example, embodiment) of the image forming apparatus shown in FIG. 8 illustrating movement of a center of gravity of an upper unit included in the image forming apparatus.
Figure 18:
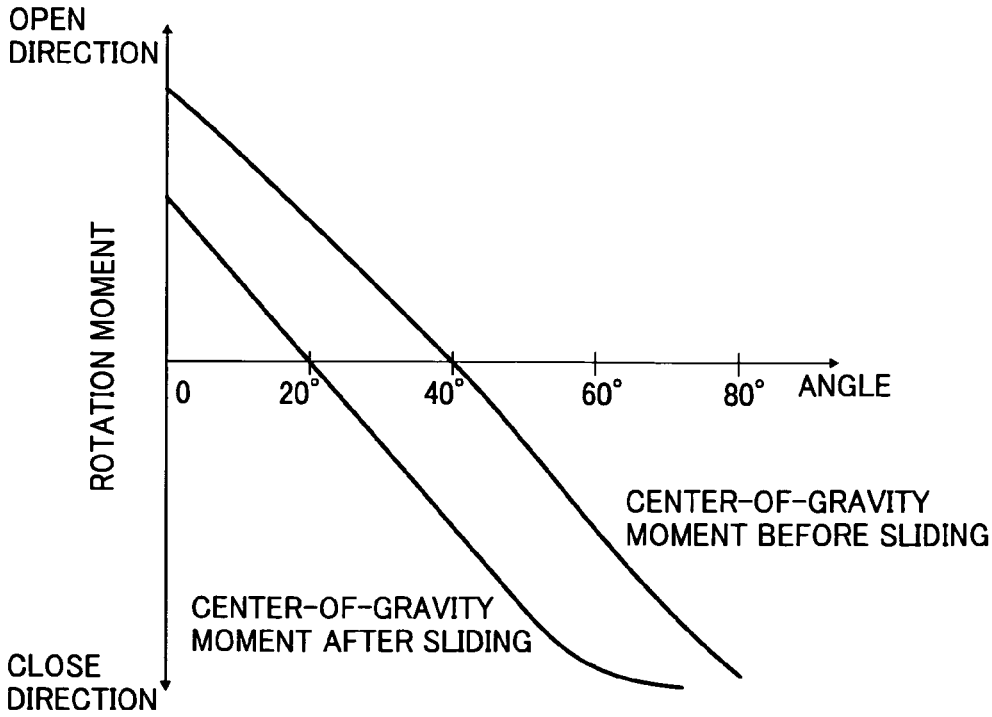
FIG. 18 is a graph (according to an example embodiment) illustrating a relation between an angle at which the upper unit shown in FIG. 17 is opened and a rotation moment of the upper unit.

The elastic member 1660 presses the counter cam 1650 against the arm 1630. Namely, the cams 1650A and 1630A press each other. Accordingly, torque for rotating the arm 1630 is applied to the arm 1630. The damper 500B having the above-described structure may provide flexible setting of torque generation direction and distribution. For example, when the upper unit 1500 is opened to form an angle of about 40 degrees with respect to the horizontal plane, as illustrated in FIG. 17, and the center of gravity of the upper unit 1500 is immediately above the shaft 1310 serving as a rotary shaft of the upper unit 1500, the cam 1650A engages with the cam 1630A, as illustrated in FIG. 16B, in such a manner that the cams 1650A and 1630A do not generate torque as illustrated in a graph showing a relation between an angle at which the upper unit 1500 is opened and a rotation moment of the upper unit 1500 in FIG. 18. Therefore, the cam 1650A may engage with the cam 1630A in such a manner that torque for rotating the arm 1630 is applied in an open direction for opening the upper unit 1500 when the upper unit 1500 is opened to form an angle of from 0 degree to about 40 degrees and torque for rotating the arm 1630 is applied in a close direction for closing the upper unit 1500 when the upper unit 1500 is opened to form an angle not smaller than about 40 degrees.

Figure 16C:
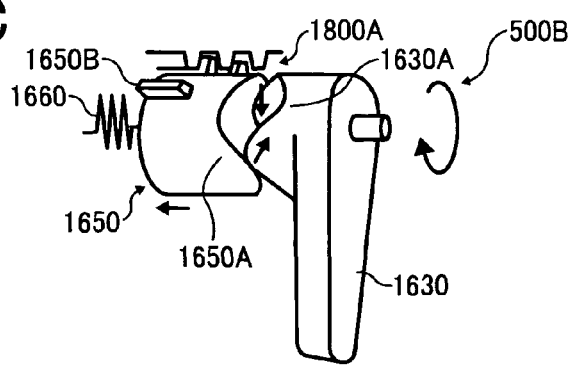
FIG. 16C is a perspective view (according to an example embodiment) of the damper shown in FIG. 16A when an upper unit included in the image forming apparatus shown in FIG. 8 is opened by about 80 degrees.

For example, when the cam 1650A engages with the cam 1630A, as illustrated in FIG. 16B, so that the upper unit 1500 is opened to form an angle of about 40 degrees with respect to the horizontal plane, torque for rotating the arm 1630 is applied in the open direction for opening the upper unit 1500. When the cam 1650A engages with the cam 1630A, as illustrated in FIG. 16C, so that the upper unit 1500 is opened to form an angle of about 80 degrees with respect to the horizontal plane, torque for rotating the arm 1630 is applied in the close direction for closing the upper unit 1500. Thus, the damper 500B may generate a damper force corresponding to a track on which the center of gravity of the upper unit 1500 moves.

Figure 16D:
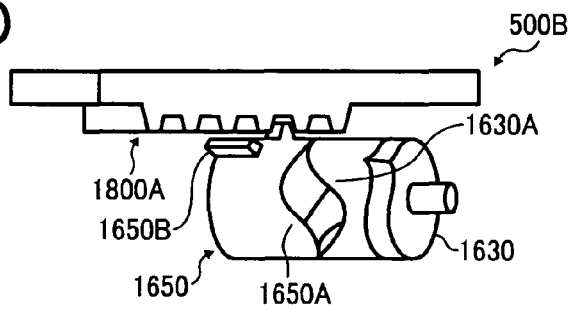
FIG. 16D is a perspective view (according to an example embodiment) of the damper shown in FIG. 16A before a slide portion included in the image forming apparatus shown in FIG. 8 starts sliding.
Figure 16E:
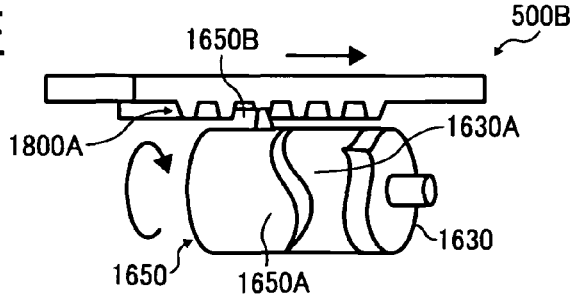
FIG. 16E is a perspective view (according to an example embodiment) of the damper shown in FIG. 16A after a slide portion included in the image forming apparatus shown in FIG. 8 starts sliding.

As illustrated in FIG. 17, when the slide portion 1800, on which a heavy device (e.g., a scanner) is mounted, slides toward the rear side of the image forming apparatus 9000A, the center of gravity of the upper unit 1500 moves as the upper unit 1500 is opened. For example, the upper unit 1500 does not easily rotate toward the front side of the image forming apparatus 9000A but tends to rotate toward the rear side of the image forming apparatus 9000A. To correct such tendency, when the slide portion 1800 mounted on the upper unit 1500 slides toward the rear side of the image forming apparatus 9000A, the gear 1800A (depicted in FIG. 16D) provided on the bottom surface of the upper unit 1500 rotates the gear 1650B from a pre-slide position illustrated in FIG. 16D to a post-slide position illustrated in FIG. 16E.

As illustrated in FIG. 17, when the upper unit 1500 is opened to form an angle of about 0 degree, a force for opening the upper unit 1500 decreases. A force applied in the close direction for closing the upper unit 1500 generates at a lower angle. Namely, the direction of the force for rotating the upper unit 1500 is switched to the close direction at a lower angle. Accordingly, even when the slide portion 1800 starts sliding, the damper 500B (depicted in FIG. 16A) may provide an optimized damper performance equivalent to an optimized damper performance provided before the slide portion 1800 starts sliding. Consequently, the user needs not apply an increased force to open and close the upper unit 1500.

As illustrated in FIG. 16A, according to this example embodiment, both engaging portions of the arm 1630 and the counter cam 1650 (e.g., the cams 1630A and 1650A) are cam-shaped. Alternatively, one of the engaging portions may be cam-shaped. For example, one of the engaging portions may be cam-shaped and another one of the engaging portions may be a protrusion for constantly contacting the cam-shaped engaging portion so as to provide an effect equivalent to the effect provided by the cams 1630A and 1650A. To cause the cam-shaped engaging portion to effectively transmit torque in a direction of rotation of the arm 1630, the cam-shaped engaging portion may preferably include cams repeated every 180 degrees and two protrusions symmetrically provided with respect to a center shaft.

As illustrated in FIG. 8, according to the above-described example embodiments, the image forming apparatus 9000A (e.g., a copier) includes the image forming device 1000, the upper unit 1500, the slide portion 1800, a force applier, and a force adjuster. The image forming device 1000 forms an image on a recording medium. The upper unit 1500 rotates about the shaft 1310, serving as a first shaft, with respect to the image forming device 1000. The slide portion 1800 is provided on the upper unit 1500 and slides in a direction perpendicular to an axial direction of the shaft 1310. The force applier applies a force to the upper unit 1500 in an open direction in which the upper unit 1500 opens with respect to the image forming device 1000.

As the slide portion 1800 slides with respect to the upper unit 1500 in a forward direction (e.g., the direction A) from a side opposite to a side in which the shaft 1310 of the upper unit 1500 is attached to the side in which the shaft 1310 is attached, the force adjuster adjusts and decreases the force applied by the force applier to the upper unit 1500. Thus, even when a center of gravity of the upper unit 1500 moves in the forward direction as the upper unit 1500 is opened, the force adjuster decreases the force applied to the upper unit 1500 in the open direction, preventing the upper unit 1500 from quickly rotating toward a rear side of the shaft 1310. On the contrary, when a user of the image forming apparatus 9000A closes the upper unit 1500, the decreased force is applied to the upper unit 1500 in the open direction. Therefore, even when a center of gravity of the upper unit 1500 moves in the forward direction, the user needs not apply an increased force to close the upper unit 1500. Namely, even when the slide portion 1800 mounted on the upper unit 1500 slides and thereby the center of gravity of the upper unit 1500 moves, the image forming apparatus 9000A may provide a proper damper performance. For example, the damper 500A manufactured at reduced costs may provide safe opening and closing of the upper unit 1500 carrying the slide portion 1800 and rotatable with respect to the image forming device 1000.

The force applier includes the arm 1620, the slide rail 1610, and the torsion spring 1640 (depicted in FIG. 9). The arm 1620 rotates about the rotary shaft 1620D (depicted in FIG. 9), serving as a second shaft, provided in the upper unit 1500 with respect to the upper unit 1500. The slide rail 1610 is provided in the image forming device 1000 and serves as a guide for guiding a free end of the arm 1620 along a guide surface of the slide rail 1610. The torsion spring 1640 serves as a torque generation member for applying torque for rotating the arm 1620 to the arm 1620. The arm 1620 receives the torque applied by the torsion spring 1640 and thereby presses the guide surface of the slide rail 1610. Thus, the force applier applies a force to the upper unit 1500 in the open direction in which the upper unit 1500 is opened with respect to the image forming device 1000. As the slide portion 1800 slides with respect to the upper unit 1500 in the forward direction from the side opposite to the side in which the shaft 1310 of the upper unit 1500 is attached to the side in which the shaft 1310 is attached, the force adjuster decreases the torque applied by the torsion spring 1640 to the arm 1620.

A pressure with which the arm 1620 presses the guide surface of the slide rail 1610 changes as the slide portion 1800 slides. Accordingly, a force applied by the force applier to the upper unit 1500 in the open direction in which the upper unit 1500 is opened with respect to the image forming device 1000 also changes. To address this, the torque applied by the torsion spring 1640 to the arm 1620 may be adjusted to a reference level according to a slide position to which the slide portion 1800 slides so as to adjust the force applied to the upper unit 1500 in the open direction to a proper level according to the slide position to which the slide portion 1800 slides. Namely, as the slide portion 1800 slides toward the shaft 1310, the torque applied by the torsion spring 1640 to the arm 1620 is decreased. Accordingly, the arm 1620 presses the guide surface of the slide rail 1610 with a decreased pressure. Consequently, the force applied to the upper unit 1500 in the open direction decreases. Thus, even when the center of gravity of the upper unit 1500 moves toward the rear side of the image forming apparatus 9000A as the upper unit 1500 is opened, the upper unit 1500 may not rotate quickly toward the rear side of the shaft 1310 because the force applied to the upper unit 1500 in the open direction is decreased. Moreover, even when the center of gravity of the upper unit 1500 moves toward the rear side of the image forming apparatus 9000A while the upper unit 1500 is closed, the user needs not apply an increased force to the upper unit 1500 to close the upper unit 1500 because the force applied to the upper unit 1500 in the open direction is decreased. As described above, even when the slide portion 1800 slides on the upper unit 1500 and thereby the center of gravity of the upper unit 1500 moves, the image forming apparatus 9000A may provide a proper damper performance. Namely, the upper unit 1500, which carries the slide portion 1800 and rotates with respect to the image forming device 1000, may be opened and closed safely by a damper (e.g., the damper 500A) manufactured at reduced costs.

As illustrated in FIG. 9, according to the above-described example embodiments, one end of the torsion spring 1640, serving as a torque generation member, engages with a part of the upper unit 1500 (depicted in FIG. 8) and another end of the torsion spring 1640 engages with the arm 1620. The gear 1800A, serving as a rack, is provided along a slide direction of the slide portion 1800 in which the slide portion 1800 slides on the upper unit 1500. The gear 1700A is provided on a circumferential surface of the support member 1700, serving as a rotation member, and engages with the gear 1800A. The support member 1700 is used as the part of the upper unit 1500 with which the one end of the torsion spring 1640 engages. The torsion spring 1640 is coiled in such a manner that the torque applied by the torsion spring 1640 to the arm 1620 decreases as the slide portion 1800 slides with respect to the upper unit 1500 in the forward direction. Thus, the support member 1700 and the gears 1700A and 1800A serve as a force adjuster for adjusting the torque applied by the torsion spring 1640 to the arm 1620. Accordingly, the image forming apparatus 9000A may provide a damper (e.g., the damper. 500A) manufactured at reduced costs to provide a damper function when the upper unit 1500 is opened and closed.

As illustrated in FIG. 16C, according to the above-described example embodiments, the torque generator includes the force applier and the force adjuster. For example, the torque generator includes the cam 1630A, the counter cam 1650, and the elastic member 1660. The cam 1630A is provided in a thrust direction of the arm 1630. The counter cam 1650 includes the cam 1650A. The cam 1650A opposes the cam 1630A of the arm 1630 from the thrust direction of the rotary shaft 1620D (depicted in FIG. 16A) of the arm 1630. The elastic member 1660 presses the counter cam 1650 toward the arm 1630. The cam 1630A of the arm 1630 presses the cam 1650A of the counter cam 1650. When the cams 1630A and 1650A rotate, the torque generator may provide a torque angle property corresponding to the shape of the cams 1630A and 1650A, generating an optimum torque generation distribution corresponding to movement of the center of gravity of the slide portion 1800 (depicted in FIG. 8).

Alternatively, the torque generator includes a protrusion, the counter cam 1650, and the elastic member 1660. The protrusion is provided in the thrust direction of the arm 1630. The counter cam 1650, serving as a counter member, includes the cam 1650A. The cam 1650A opposes the protrusion of the arm 1630 from the thrust direction of the rotary shaft 1620D (depicted in FIG. 16A) of the arm 1630. The elastic member 1660 presses the counter cam 1650 toward the arm 1630. When the cam 1650A rotates, the torque generator may provide a torque angle property corresponding to the shape of the cam 1650A, generating an optimum torque generation distribution corresponding to movement of the center of gravity of the slide portion 1800.

Alternatively, the torque generator includes the cam 1630A, the counter cam 1650, and the elastic member 1660. The cam 1630A is provided in the thrust direction of the arm 1630. The counter cam 1650 includes a protrusion. The protrusion opposes the cam 1630A of the arm 1630 from the thrust direction of the rotary shaft 1620D of the arm 1630. The elastic member 1660 presses the counter cam 1650 toward the arm 1630. When the cam 1630A rotates, the torque generator may provide a torque angle property corresponding to the shape of the cam 1630A, generating an optimum torque generation distribution corresponding to movement of the center of gravity of the slide portion 1800.

As illustrated in FIG. 8, according to the above-described example embodiments, the image forming device 1000 may include an image forming unit for forming an image on a recording medium. The image forming unit is provided inside the image forming device 1000 but may be replaced with new one when abnormal impact is applied to the image forming apparatus 9000A. In this case, the upper unit 1500 may be opened and closed repeatedly. However, the damper 500A, serving as an open-close mechanism for opening and closing the upper unit 1500, may open and close the upper unit 1500 safely and precisely.

As illustrated in FIG. 1, according to the above-described example embodiments, the scanner 2000, serving as an image scanner for scanning an image on an original document sheet, is provided in the upper unit 1500. Like in a copier (e.g., the image forming apparatus 9000), the scanner 2000 is generally provided above the image forming device 1000 to save space. When the scanner 2000 is lifted and lowered together with the upper unit 1500, the scanner 2000 may not disturb opening and closing of the upper unit 1500 to expose an interior of the image forming apparatus 9000.

The scanner 2000 may be included in the slide portion 1800 (depicted in FIG. 8) and may be provided independently of the image forming device 1000. Therefore, even when the scanner 2000 is displaced with respect to the image forming device 1000, the scanner 2000 may operate properly. Namely, the scanner 2000 movably provided in an upper portion of the image forming apparatus 9000 may provide improved visibility and workability of the image forming device 1000 for a user of the image forming apparatus 9000.

The upper unit 1500 includes the output tray 1210 provided in a space under the scanner 2000 or the slide portion 1800 (depicted in FIG. 8) and serving as a sheet stacker for stacking a sheet bearing an image. Thus, the output tray 1210 may occupy a reduced space. Further, when the slide portion 1800 slides above the output tray 1210, the user may recognize and pick up the sheet easily.

As illustrated in FIG. 2, according to the above-described example embodiments, at least two of the photoconductor 1 serving as an image carrier, the development device 3, the charger 2, and the cleaner 4 are integrated into the process cartridge 110. The process cartridge 110 is attachable to and detachable from the image forming apparatus 9000. The process cartridge 110 is provided in the image forming device 1000. For example, when the upper unit 1500 (depicted in FIG. 1) is opened, the process cartridge 110 is exposed. Namely, opening the upper unit 1500 may cause the user to replace the process cartridge 110 with new one. In other words, the user may replace the process cartridge 110 easily with reduced processes of opening a part of the image forming apparatus 9000 once and picking up the process cartridge 110.

As illustrated in FIG. 9, according to the above-described example embodiments, an oil damper may be provided on the rotary shaft 1620D in addition to the torque generator. Thus, even when the user handles the upper unit 1500 (depicted in FIG. 8) roughly, the oil damper may generate torque corresponding to a speed of opening and closing the upper unit 1500, preventing damage to the upper unit 1500 or the other elements of the image forming apparatus 9000A (depicted in FIG. 8).

As illustrated in FIG. 8, according to the above-described example embodiments, the elastic member 1810 is provided on the upper unit 1500 to press the slide portion 1800 toward the front side of the image forming apparatus 9000A. Thus, when the user slides the slide portion 1800, the elastic member 1810 cancels a force (e.g., torque) of the torsion spring 1640 (depicted in FIG. 9) to press the slide portion 1800 toward the rear side of the image forming apparatus 9000A via the gears 1700A and 1800A. Accordingly, the user may slide the slide portion 1800 with a decreased force.

As illustrated in FIG. 10, according to the above-described example embodiments, the slide lock switch 1400 fixes the slide portion 1800 to the upper unit 1500 so that the slide portion 1800 does not move on the upper unit 1500. When the slide lock switch 1400 fixes the slide portion 1800 to the upper unit 1500, the gear 1800A (depicted in FIG. 9) does not engage with the gear 1700A (depicted in FIG. 9). When the slide lock switch 1400 does not fix the slide portion 1800 to the upper unit 1500, the gear 1800A engages with the gear 1700A. Namely, the gears 1700A and 1800A do not receive torque generated between the torque generator and the arm 1620 (depicted in FIG. 9). In other words, the gears 1700A and 1800A do not receive a load generated when the upper unit 1500 is opened and closed, preventing damage to the gears 1700A and 1800A and movement of the slide portion 1800 due to a drive transmitted to the slide portion 1800 when the upper unit 1500 is opened and closed.

As illustrated in FIG. 8, according to the above-described example embodiments, a damper (e.g., the damper 500A) is provided between the image forming device 1000, serving as a lower unit, and the upper unit 1500. On the upper unit 1500, the slide portion 1800 is provided to slide in the direction perpendicular to the axial direction of the shaft 1310 serving as a first shaft. The upper unit 1500 rotates about the shaft 1310 provided in the image forming device 1000. The force applier applies a force to the upper unit 1500 in the open direction in which the upper unit 1500 is opened with respect to the image forming device 1000. As the slide unit 1800 slides with respect to the upper unit 1500 in the forward direction from the side opposite to the side in which the shaft 1310 of the upper unit 1500 is attached to the side in which the shaft 1310 is attached, the force adjuster adjusts and decreases the force applied by the force applier to the upper unit 1500. For example, even when the center of gravity of the upper unit 1500 moves in the forward direction as the user opens the upper unit 1500, the force applied to the upper unit 1500 in the open direction may decrease to prevent the upper unit 1500 from quickly rotating behind the shaft 1310 toward the rear side of the image forming apparatus 9000A. On the contrary, when the user closes the upper unit 1500, the decreased force applied to the upper unit 1500 in the open direction may not cause the user to close the upper unit 1500 with an increased force even when the center of gravity of the upper unit 1500 moves in the forward direction. Namely, even when the slide portion 1800 slides on the upper unit 1500 and thereby the center of gravity of the upper unit 1500 moves, the damper 500A may provide a proper damper performance. Moreover, the damper 500A may be manufactured at reduced costs and may provide safe opening and closing of the upper unit 1500 carrying the slide portion 1800 and rotatable with respect to the image forming device 1000.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. An image forming apparatus, comprising:

an image forming device to form an image on a sheet;

a first shaft provided in the image forming device;

an upper unit to rotate about the first shaft with respect to the image forming device;

a slide portion provided on the upper unit to slide reciprocally in a forward direction toward a side of the image forming device in which the first shaft is provided and a backward direction opposite to the forward direction, the forward direction and the backward direction being perpendicular to an axial direction of the first shaft;

a force applier to apply a force to the upper unit in an open direction, in which the upper unit is opened with respect to the image forming device; and a force adjuster to decrease the force applied by the force applier to the upper unit as the slide portion slides with respect to the upper unit in the forward direction.

2. The image forming apparatus according to claim 1, further comprising a second shaft provided in the upper unit, wherein the force applier comprises:

an arm to rotate about the second shaft with respect to the upper unit, one end of the arm supported by the second shaft;

a guide provided in the image forming device to guide another end of the arm not supported by the second shaft along a guide surface of the guide; and a torque generation member to apply torque to the arm, wherein the arm receives the torque applied by the torque generation member and presses the guide surface of the guide to apply the force to the upper unit in the open direction in which the upper unit is opened, and wherein the force adjuster decreases the torque applied by the torque generation member to the arm as the slide portion slides with respect to the upper unit in the forward direction.

3. The image forming apparatus according to claim 2, wherein the force adjuster comprises:

a rack provided in the slide portion in the forward direction and the backward direction in which the slide portion slides; and a rotation member provided in the upper unit and comprising a gear provided in a circumferential direction of the rotation member to engage the rack, wherein the torque generation member comprises a torsion spring including one end attached to the rotation member and another end attached to the arm, and wherein the torque generation member is wound in such a manner that the force adjuster decreases the torque applied by the torque generation member to the arm as the slide portion slides with respect to the upper unit in the forward direction.

4. The image forming apparatus according to claim 3, further comprising a slide lock switch to lock the slide portion to the upper unit so that the slide portion does not move with respect to the upper unit, wherein the rack provided in the slide portion does not engage with the gear of the force adjuster when the slide lock switch locks the slide portion to the upper unit, and the rack engages with the gear when the lock is released.

5. The image forming apparatus according to claim 2, further comprising a torque generator comprising the torque generation member and the force adjuster, the torque generator further comprising:

a first cam provided on the arm in a thrust direction of the arm;

a counter member comprising a second cam to oppose the first cam in the thrust direction of the arm; and an elastic member to press the counter member toward the arm.

6. The image forming apparatus according to claim 2, further comprising a torque generator comprising the force applier and the force adjuster, the torque generator further comprising:

a protrusion provided on the arm in a thrust direction of the arm;

a counter member comprising a cam to oppose the protrusion in the thrust direction of the arm; and an elastic member to press the counter member toward the arm.

7. The image forming apparatus according to claim 2, further comprising a torque generator comprising the force applier and the force adjuster, the torque generator further comprising:

a cam provided on the arm in a thrust direction of the arm;

a counter member comprising a protrusion to oppose the cam in the thrust direction of the arm; and an elastic member to press the counter member toward the arm.

8. The image forming apparatus according to claim 1, further comprising an image scanner provided on the upper unit to scan an original document image.

9. The image forming apparatus according to claim 1, wherein the upper unit comprises a sheet stacker in a space under the slide portion to stack the sheet bearing the image.

10. The image forming apparatus according to claim 1, further comprising an elastic member attached to the upper unit to apply a force for pulling the slide portion in the backward direction.

11. A damper provided between a lower unit and an upper unit carrying a slide portion for sliding in a direction perpendicular to an axial direction of a first shaft provided in the lower unit, the upper unit rotatable about the first shaft with respect to the lower unit, the damper comprising:

a force applier to apply a force to the upper unit in an open direction in which the upper unit is opened with respect to the lower unit; and a force adjuster to decrease the force applied by the force applier to the upper unit as the slide portion slides with respect to the upper unit in a forward direction toward a side of the lower unit in which the first shaft is provided.

12. An image forming apparatus, comprising:

an image forming device to form an image on a sheet;

a first shaft provided in the image forming device;

an upper unit to rotate about the first shaft with respect to the image forming device;

a slide portion provided on the upper unit to slide reciprocally in a forward direction toward a side of the image forming device in which the first shaft is provided and a backward direction opposite to the forward direction, the forward direction and the backward direction being perpendicular to an axial direction of the first shaft;

means for applying a force to the upper unit in an open direction in which the upper unit is opened with respect to the image forming device; and means for decreasing the force applied by the means for applying to the upper unit as the slide portion slides with respect to the upper unit in the forward direction.

* * * * *